US008896635B2

(12) United States Patent
Owaku

(10) Patent No.: US 8,896,635 B2
(45) Date of Patent: Nov. 25, 2014

(54) DISPLAY DEVICE

(75) Inventor: Yoshihara Owaku, Mobara (JP)

(73) Assignees: Japan Display Inc., Tokyo (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 1001 days.

(21) Appl. No.: 12/853,399

(22) Filed: Aug. 10, 2010

(65) Prior Publication Data

US 2011/0032284 A1 Feb. 10, 2011

(30) Foreign Application Priority Data

Aug. 10, 2009 (JP) ..... 2009-185821

(51) Int. Cl.
*G09G 5/10* (2006.01)
*G09G 3/36* (2006.01)

(52) U.S. Cl.
CPC ..... *G09G 3/3614* (2013.01)
USPC ..... 345/690; 345/99; 345/103; 345/87; 345/211

(58) Field of Classification Search
USPC ..... 345/690, 103
See application file for complete search history.

(56) References Cited

U.S. PATENT DOCUMENTS

| | | | | |
|---|---|---|---|---|
| 7,545,394 | B2 * | 6/2009 | Nose et al. | 345/690 |
| 2005/0001800 | A1 * | 1/2005 | Ha | 345/87 |
| 2006/0221101 | A1 * | 10/2006 | Azami | 345/690 |
| 2007/0115231 | A1 | 5/2007 | Kumeta | |
| 2007/0120810 | A1 * | 5/2007 | You et al. | 345/103 |
| 2008/0180462 | A1 * | 7/2008 | Nose | 345/690 |
| 2009/0225019 | A1 * | 9/2009 | Miyazawa et al. | 345/99 |
| 2010/0079435 | A1 * | 4/2010 | Yasuda | 345/211 |

FOREIGN PATENT DOCUMENTS

JP 2007-140296 6/2007

* cited by examiner

*Primary Examiner* — Gerald Johnson
(74) *Attorney, Agent, or Firm* — Antonelli, Terry, Stout & Kraus, LLP.

(57) ABSTRACT

A display device includes first transistors provided for every scanning line and second transistors having a first electrode connected to each scanning line and a second electrode to which a reference potential is inputted. A first electrode of the first transistor is connected to any one of gate lines belonging to a first group. A control electrode of the first transistor is connected to any one of gate lines belonging to a second group. A control electrode of the second transistor is connected to any one of reverse gate lines belonging to a second group. A scanning line drive circuit intermittently outputs, when the scanning line drive circuit outputs a non-selective scanning voltage to any one of the gate lines belonging to the second group, a selective reversal scanning voltage to a reverse gate line corresponding to the gate line in the reverse gate lines belonging to the second group.

11 Claims, 12 Drawing Sheets

DISPLAY DEVICE

CROSS-REFERENCE TO RELATED APPLICATION

The present application claims priority from Japanese application JP 2009-185821 filed on Aug. 10, 2009, the content of which is hereby incorporated by reference into this application.

BACKGROUND OF THE INVENTION

1. Field of the Invention

The present invention relates to a display device such as a liquid crystal display device or an EL display device, and more particularly to a technique for reducing wiring from a video line drive circuit or a scanning line drive circuit to a display panel.

2. Description of the Related Art

Currently, as a liquid crystal display panel which is used in a liquid crystal television receiver set, a mobile phone or the like, a TFT-type liquid crystal display device is used. FIG. 1 shows an equivalent circuit of a conventional TFT-type active matrix liquid crystal display panel.

As shown in FIG. 1, the conventional liquid crystal display panel includes, on a liquid-crystal-side surface of one substrate of a pair of substrates which is arranged to face each other in an opposed manner with liquid crystal sandwiched therebetween, a plurality of scanning lines (also referred to as "gate lines") (GL) and a plurality of video lines (also referred to as "source lines" or "drain lines") (DL).

Regions surrounded by the scanning lines and the video lines constitute sub pixel regions, and each sub pixel region is provided with a thin film transistor (TFT) which has a gate thereof connected to the scanning line, a drain (or a source) thereof connected to the video line, and the source (or the drain) thereof connected to a pixel electrode (PX) and constitutes an active element.

Since liquid crystal is interposed between the pixel electrode (PX) and a counter electrode (CT), a liquid crystal capacitance (Clc) is formed between the pixel electrode (PX) and the counter electrode (CT). Although a holding capacitance (Cadd) is provided between the pixel electrode (PX) and the counter electrode (also referred to as "common electrode") (CT) in the actual constitution, the description of the holding capacitance (Cadd) is omitted in FIG. 1.

The respective scanning lines (GL) are connected to a vertical scanning circuit (also referred to as "gate driver") (XDV), and the vertical scanning circuit (XDV) supplies a selection scanning signal to the respective scanning lines (GL) sequentially. The respective video lines (DL) are connected to a horizontal scanning circuit (also referred to as "source driver" or "drain driver") (YDV), and the horizontal scanning circuit (YDV) outputs video voltages (so-called grayscale voltages) of R, G, B to the respective video lines (DL) within 1 horizontal scanning period. Here, JP-A-2007-140296 (patent document 1) discloses a technique which can decrease the number of outputs of a driver which drives video lines by performing the selection of the video lines by time division using RGB switches.

With respect to the thin film transistor (TFT), there has been known a thin film transistor in which a semiconductor layer is formed of an amorphous silicon layer (hereinafter referred to as "a-Si thin film transistor"), and a thin film transistor in which a semiconductor layer is formed of a polysilicon layer (hereinafter referred to as "poly-Si thin film transistor"). Recently, there has been also known a thin film transistor (TFT) in which a semiconductor layer is formed of a microcrystalline silicon layer (hereinafter referred to as "microcrystalline thin film transistor"). The microcrystalline thin film transistor exhibits performance between the performance of the a-Si thin film transistor and the performance of the poly-Si thin film transistor.

In general, a liquid crystal display panel for a liquid crystal television receiver set uses the a-Si thin film transistor as an active element thereof, and a liquid crystal display panel for a mobile phone uses the poly-Si thin film transistor as an active element thereof.

An operating speed of the poly-Si thin film transistor is two-orders of magnitude faster than an operating speed of the a-Si thin film transistor. Accordingly, in the liquid crystal display panel which uses the poly-Si thin film transistor as the active element thereof, the vertical scanning circuit (XDV) is formed of the poly-Si thin film transistor, and the vertical scanning circuit (XDV) is formed on a liquid-crystal-side surface of one substrate of a pair of substrates which constitutes the liquid crystal display panel.

The operating speed of the a-Si thin film transistor or the operating speed of the microcrystalline thin film transistor is slower than the operating speed of the p-Si thin film transistor. Accordingly, in the liquid crystal display panel which uses the a-Si thin film transistor or the microcrystalline thin film transistor as the active element thereof, a semiconductor chip which mounts the vertical scanning circuit (XDV) thereon is mounted on one substrate of a pair of substrates which constitutes the liquid crystal display panel, for example.

In general, as a method for mounting a semiconductor chip which constitutes the vertical scanning circuit (XDV) and the horizontal scanning circuit (YDV), there has been known a method in which a semiconductor chip which constitutes the vertical scanning circuit (XDV) and a semiconductor chip which constitutes the horizontal scanning circuit (YDV) are separately mounted on one substrate of a pair of substrates which is arranged to face each other in an opposed manner with liquid crystal sandwiched therebetween as shown in FIG. 1, and a method in which a semiconductor chip which constitutes a scanning circuit (RDV) which is formed by integrating the vertical scanning circuit (XDV) and the horizontal scanning circuit (YDV) is mounted on one substrate of a pair of substrates which is arranged to face each other in an opposed manner with liquid crystal sandwiched therebetween as shown in FIG. 2.

In either method, a selection scanning voltage is supplied to the respective scanning lines (GL) from the vertical scanning circuit (XDV) (or the scanning circuit (RDV)) and hence, it is necessary to provide the gate lines which connect the vertical scanning circuit (XDV) (or the scanning circuit (RDV)) and the respective scanning lines (GL) in such a manner that the number of gate lines is equal to the number of the scanning lines (GL).

However, in a miniaturized panel such as a liquid crystal display panel for a mobile phone or the like, when the number of pixel is increased to satisfy a demand for higher definition, there exists a possibility that gate lines cannot be arranged in the inside of the liquid crystal display panel. To cope with such a situation, considered is a line address drive method where in driving the scanning lines (GL), only scanning lines (GL) whose addresses are designated are selected.

In FIG. 1 and FIG. 2, symbol VSYNC indicates a vertical synchronizing signal, symbol HSYNC indicates a horizontal synchronizing signal, symbol CK indicates a dot clock, and symbol Data indicates video data.

SUMMARY OF THE INVENTION

In the line address drive method, only specified scanning lines are brought into an ON state by combining outputs of a vertical scanning circuit (XDV) (or a scanning circuit (RDV)) (thus constituting an address). When the address constitution of the vertical scanning circuit (XDV) (or the scanning circuit (RDV)) adopts the one-stage-layer (plane) constitution, the number of gate lines becomes equal to the total number of video lines (GL). However, when the address constitution of the vertical scanning circuit (XDV) (or the scanning circuit (RDV)) adopts the two-stage-layer constitution, the total number of gate lines can be reduced to the number which is approximately twice as large as the square root of the total number of scanning lines (GL). In this manner, the line address drive method can effectively reduce the number of gate lines in the inside of the liquid crystal display panel and hence, the line address drive method is a drive method which contributes to the narrowing of a picture frame of the liquid crystal display panel.

In general, in the above-mentioned line address drive method, a resetting thin film transistor is provided for fixing the scanning line (GL) to a ground potential (reset potential) during an approximately 1 frame period after the scanning line (GL) is selected by the vertical scanning circuit (XDV) (or the scanning circuit (RDV)).

A ground potential is supplied to a source of the resetting thin film transistor, and the scanning line (GL) is connected to a drain of the resetting thin film transistor. Further, to a gate of the resetting thin film transistor, a signal which usually turns off the resetting thin film transistor only during a period where a selective scanning voltage is supplied to the scanning line (GL) and turns on the resetting thin film transistor during other periods (almost 1 frame period) is applied.

In general, with respect to an operation lifetime of a thin film transistor, it has been reported that a magnitude of stress is defined based on a potential difference between a gate and a source or between the gate and a drain of the thin film transistor and a potential difference applying time, and an ON current of the thin film transistor is lowered or a threshold value of the thin film transistor is shifted due to such a stress.

When the line address drive method is used, the selective scanning voltage is supplied to the scanning line (GL) one time during 1 frame period and hence, the resetting thin film transistor for fixing the scanning line (GL) to the ground potential is held in an ON state continuously during almost 1 frame period.

Accordingly, due to an excessive stress generated based on the potential difference between the gate and the source or between the gate and the drain of the resetting thin film transistor and the potential difference applying time, there exists a possibility that the resetting thin film transistor is deteriorated so that the reliability of the liquid crystal display panel cannot be ensured.

The present invention has been made to overcome the above-mentioned drawbacks of the related art, and it is an object of the present invention to provide a technique which can prevent the deterioration of a resetting thin film transistor by reducing a stress applied to the resetting thin film transistor in a display device which adopts a line address drive method.

The above-mentioned objects, other objects and novel technical features of the present invention will become apparent from the description of this specification and attached drawings.

To briefly explain the summary of typical inventions among the inventions described in this specification, they are as follows.

(1) According to one aspect of the present invention, there is provided a display device which includes: a plurality of pixels; a plurality of scanning lines for inputting a scanning voltage to the plurality of pixels; and a scanning line drive circuit which supplies the scanning voltage to the plurality of scanning lines, wherein the plurality of scanning lines are divided into "b" pieces of first groups, each of the first groups includes 1 piece or more and "a" pieces or less of the scanning lines, "a" pieces of gate lines belonging to a first group, "b" pieces of gate lines belonging to a second group, and "b" pieces of reverse gate lines belonging to the second group are connected to the scanning line drive circuit, a second electrode of a first transistor and a first electrode of a second transistor are connected to each of the plurality of scanning lines, a predetermined reference potential is applied to a second electrode of the second transistor, a first electrode of the first transistor is connected to any one of the gate lines belonging to the first group, a control electrode of the first transistor is connected to any one of the gate lines belonging to the second group, a control electrode of the second transistor is connected to any one of the reverse gate lines belonging to the second group, the control electrodes of the first transistors connected to the scanning lines belonging to each first group are respectively connected to the gate lines belonging to the same second group, the control electrodes of the second transistors connected to the scanning lines belonging to each first group are respectively connected to the reverse gate lines belonging to the same second group; when a selective scanning voltage which turns on the first transistor is applied to any one of the gate lines belonging to the second group, a non-selective reversal scanning voltage which turns off the second transistor is applied to the gate lines belonging to the second group to which the selective scanning voltage is applied and to the reverse gate lines belonging to the second group which are connected to the same first group of scanning lines, and when a non-selective scanning voltage which turns off the first transistor is applied to any one of the gate lines belonging to the second group, a selective reversal scanning voltage which turns on the second transistor is intermittently applied to the gate line belonging to the second group to which the non-selective scanning voltage is applied and to the reverse gate line belonging to the second group which is connected to the same first group of scanning lines.

(2) According to another aspect of the present invention, there is provided a display device which includes: a plurality of pixels; a plurality of scanning lines for inputting a scanning voltage to the plurality of pixels; and a scanning line drive circuit which supplies the scanning voltage to the plurality of scanning lines, wherein the plurality of scanning lines are divided into a plurality of first groups, the plurality of first groups are divided into "c" pieces of second groups, each of the first groups includes 1 piece or more and "a" pieces or less of the scanning lines, each of the second groups includes "b" pieces of first groups, "a" pieces of gate lines belonging to a first group, "b" pieces of gate lines belonging to a second group, "c" pieces of gate lines belonging to a third group, "b" pieces of reverse gate lines belonging to the second group, and "c" pieces of reverse gate lines belonging to the third group are connected to the scanning line drive circuit, each of the plurality of scanning lines includes a circuit constituted of a first transistor, a second transistor, a third transistor and a fourth transistor, the first transistor and the second transistor are connected to each other in series, a second electrode of the second transistor is connected to the scanning line, the third transistor and the fourth transistor have respective first electrodes thereof connected to the scanning line parallel to each other, predetermined reference potentials are applied to a second electrode of the third transistor and a second electrode of the fourth transistor respectively, a first electrode of the first transistor is connected to any one of the gate lines belonging to the first group, a control electrode of the first transistor is connected to any one of the gate lines belonging to the second group, a control electrode of the second transistor is connected to any one of the gate lines belonging to the third group, a control electrode of the third transistor is connected to any one of the reverse gate lines belonging to the second group, a control electrode of the fourth transistor is connected to any one of the reverse gate lines belonging to the third group, the control electrodes of the first transistors connected to the scanning lines belonging to each first group are respectively connected to the gate lines belonging to the same second group, the control electrodes of the second transistors connected to the scanning lines belonging to each second group are respectively connected to the gate lines belonging to the same third group, the control electrodes of the third transistors connected to the scanning lines belonging to each first group are respectively connected to the reverse gate lines belonging to the same second group; the control electrodes of the fourth transistors connected to the scanning lines belonging to each second group are respectively connected to the reverse gate lines belonging to the same third group; when a selective scanning voltage which turns on the first transistor and the second transistor is applied to any one of gate lines belonging to the second group or any one of gate lines belonging to the third group, a non-selective reversal scanning voltage which turns off the third transistor and the fourth transistor is applied to the gate lines to which the selective scanning voltage is applied, and the reverse gate lines belonging to the second group or the reverse gate lines belonging to the third group which are connected to the same first group or second group, and when a non-selective scanning voltage which turns off the first transistor and the second transistor is applied to any one of gate lines belonging to the second group or any one of gate lines belonging to the third group, a selective reversal scanning voltage which turns on the third transistor and the fourth transistor is intermittently applied to the gate lines to which the non-selective scanning voltage is applied, and the reverse gate lines belonging to the second group or the reverse gate lines belonging to the third group which are connected to the same first group or second group.

(3) According to still another aspect of the present invention, there is provided a display device which includes: a plurality of pixels; a plurality of scanning lines for inputting a scanning voltage to the plurality of pixels; and a scanning line drive circuit which supplies the scanning voltage to the plurality of scanning lines, wherein assuming N as an integer of 2 or more, the plurality of scanning lines are divided into groups ranging from a first group to an Nth group by hierarchical grouping, the hierarchical grouping is performed sequentially such that the plurality of scanning lines are divided into a plurality of first groups, the plurality of first groups are divided into a plurality of second groups, and a plurality of (N−2)th groups are divided into a plurality of (N−1)th groups, the plurality of (N−1)th groups form the N-th group, each of the first groups includes 1 piece or more and $k_1$ pieces or less of the scanning lines, each of the second groups includes $k_2$ pieces of first groups, and each of the Nth groups includes $k_N$ pieces of (N−1)th groups sequentially, a group of gate lines sequentially ranging from $k_1$ pieces of gate lines belonging to a first group and $k_2$ pieces of gate lines belonging to a second group to $k_N$ pieces of gate lines belonging to an Nth group and a group of reverse gate lines sequentially raging from $k_2$ pieces of reverse gate lines belonging to the second group to $k_N$ pieces of reverse gate lines belonging to the Nth group are connected to the scanning line drive circuit, each of the plurality of scanning lines includes a circuit constituted of (2N−2) pieces of transistors ranging from a first transistor to a (2N−2)th transistor, (N−1) pieces of transistors ranging from the first transistor to the (N−1)th transistor are connected to each other in series, a second electrode of the (N−1)th transistor is connected to the scanning line, the (N−1) pieces of transistors ranging from the Nth transistor to the (2N−2)th transistor have respective first electrodes thereof connected to the scanning line parallel to each other, a predetermined reference potential is applied to respective second electrodes of the (N−1) pieces of transistors ranging from the Nth transistor to the (2N−2)th transistor, a first electrode of the first transistor is connected to any one of the gate lines belonging to the first group, control electrodes of the first to (N−1)th transistors are sequentially connected such that the control electrode of the first transistor is connected to any one of the gate lines belonging to the second group, and the control electrode of the (N−1)th transistor is connected to any one of the gate lines belonging to the Nth group, control electrodes of the Nth to (2N−2)th transistors are sequentially connected such that the control electrode of the Nth transistor is connected to any one of reverse gate lines belonging to the second group, and the control electrode of the (2N−2)th transistor is connected to any one of the reverse gate lines belonging to the Nth group, the control electrodes of the first transistors which are connected to the scanning line which each of the first groups includes are respectively connected to the gate lines belonging to the same second group, the control electrodes of the (N−1)th transistors which are connected to the scanning line which each of the (N−1)th groups includes are respectively connected to the gate lines belonging to the same Nth group sequentially, the control electrodes of the Nth transistors which are connected to the scanning line which each of the first groups includes are respectively connected to the reverse gate lines belonging to the same second group, the control electrodes of the (2N−2)th transistors which are connected to the scanning line which each of the (N−1)th groups includes are respectively connected to the reverse gate lines belonging to the same Nth group sequentially, when a selective scanning voltage which turns on the transistor is applied to any one of the gate lines ranging from the gate lines belonging to the second group to the gate lines belonging to the Nth group, a non-selective reversal scanning voltage which turns off the transistor is applied to the gate lines to which the selective scanning voltage is applied, and any one of the reverse gate lines ranging from the reverse gate lines belonging to the second group to the reverse gate lines belonging to the Nth group which are connected to the same group among groups ranging from the first group to the (N−1)th group, and when a non-selective scanning voltage which turns off the transistor is applied to any one of gate lines ranging from the gate lines belonging to the second group to the gate lines belonging to the Nth group, a selective reversal scanning voltage which turns on the transistor is intermittently applied to the gate lines to which the non-selective scanning voltage is applied and any one of reverse gate lines ranging from the reverse gate lines belonging to the second group to the reverse gate lines belonging to the Nth group which are connected to the same group among groups ranging from the first group to the (N−1)th group.

(4) In the display device having the constitution (3), assuming a period during which the selective reversal scanning voltage is outputted to the respective reverse gate lines belonging to the second group to the Nth group from the scanning line drive circuit during 1 frame period as Ton and a period during which the non-selective reversal scanning voltage is outputted to the respective reverse gate lines belonging to the second group to the Nth group from the scanning line drive circuit during 1 frame period as Toff, the relationship of $0.05 \leq Ton/(Ton+Toff) \leq 0.5$ is satisfied.

(5) In the display device having the constitution (3) or (4), the scanning line drive circuit outputs a first selective scanning voltage to the $k_1$ pieces of gate lines belonging to the first group for selecting the scanning lines in each of the first groups for every 1 horizontal scanning period, the scanning line drive circuit outputs a second selective scanning voltage to the $k_2$ pieces of gate lines belonging to the second group for every $k_1$ horizontal scanning period sequentially, the scanning line drive circuit outputs a third selective scanning voltage to the $k_3$ pieces of gate lines belonging to the third group for every $(k_1 \times k_2)$ horizontal scanning period sequentially, and the scanning line drive circuit outputs an Nth selective scanning voltage to the $k_N$ pieces of gate lines belonging to the Nth group for every $(k_1 \times k_2 \times \ldots \times k_{(N-1)})$ horizontal scanning period sequentially.

(6) In the display device having the constitution (3) or (4), the display device further includes: a plurality of video lines for inputting a video voltage to the plurality of pixels; and a video line drive circuit which supplies the video voltage to the plurality of video lines, wherein each pixel is constituted of a sub pixel of first color, a sub pixel of second color and a sub pixel of third color, the video voltage is inputted to the sub pixel of the first color, the sub pixel of the second color and the sub pixel of the third color in each pixel from the same video line, $k_1$ pieces of gate lines belonging to the first group is constituted of scanning lines A of the first color, scanning lines B of the second color and scanning lines C of the third color, the scanning voltage is inputted to the sub pixel of the first color of each pixel from the scanning line A of the first color, the scanning voltage is inputted to the sub pixel of the second color of each pixel from the scanning line B of the second color, the scanning voltage is inputted to the sub pixel of the third color of each pixel from the scanning line C of the third color, assuming a scanning period during which the video voltage is inputted to one row of the pixels as 1 horizontal scanning period, 1 horizontal scanning period is divided into continuous first, second and third periods, and the video line drive circuit supplies the video voltage of the first color to each video line during the first period, the video voltage of the second color to each video line during the second period, and the video voltage of the third color to each video line during the third period, the scanning line drive circuit outputs a first selective scanning voltage for selecting the scanning lines A of the respective first groups during the first period, the scanning lines B of the respective first groups during the second period and the scanning lines C of the respective first groups during the third period to $k_1$ pieces of gate lines belonging to the first group for every ⅓ horizontal scanning period, the scanning line drive circuit outputs a second selective scanning voltage to $k_2$ pieces of gate lines belonging to the second group for every $(⅓ \times k_1)$ horizontal scanning period sequentially, the scanning line drive circuit outputs a third selective scanning voltage to $k_3$ pieces of gate lines belonging to the third group for every $(⅓ \times k_1 \times k_2)$ horizontal scanning period sequentially, and the scanning line drive circuit outputs an Nth selective scanning voltage to the $k_N$ pieces of gate lines belonging to the Nth group for every $(⅓ \times k_1 \times k_2 \times \ldots \times k_{(N-1)})$ horizontal scanning period sequentially.

(7) In the display device having any one of the constitutions (1) to (6), the scanning line drive circuit is a circuit which is constituted of a thin film transistor where a semiconductor layer is formed of a polysilicon layer or a stacked layer of a polysilicon layer and an amorphous silicon layer, and the scanning line drive circuit is formed around a display part where the plurality of pixels are arranged.

(8) In the display device having any one of the constitutions (1) to (7), the scanning line drive circuit is a circuit which is constituted of a thin film transistor where a semiconductor layer is formed of a microcrystalline silicon layer or a stacked layer of a microcrystalline silicon layer and an amorphous silicon layer, and the scanning line drive circuit is formed around a display part where the plurality of pixels are arranged.

(9) In the display device having any one of the constitutions (1) to (7), the scanning line drive circuit is a circuit which is mounted in a semiconductor chip.

To briefly explain advantageous effects acquired by typical inventions among the inventions described in this specification, they are as follows.

According to the present invention, in the display device driven by a line address drive method, a stress applied to the resetting thin film transistor can be decreased thus preventing the deterioration of the resetting thin film transistor.

DETAILED DESCRIPTION OF THE INVENTION

Hereinafter, embodiments of the present invention are explained in detail in conjunction with drawings.

In all drawings provided for explaining the embodiments, parts having identical functions are given same symbols and their repeated explanation is omitted.

Embodiment 1

Figure 3:
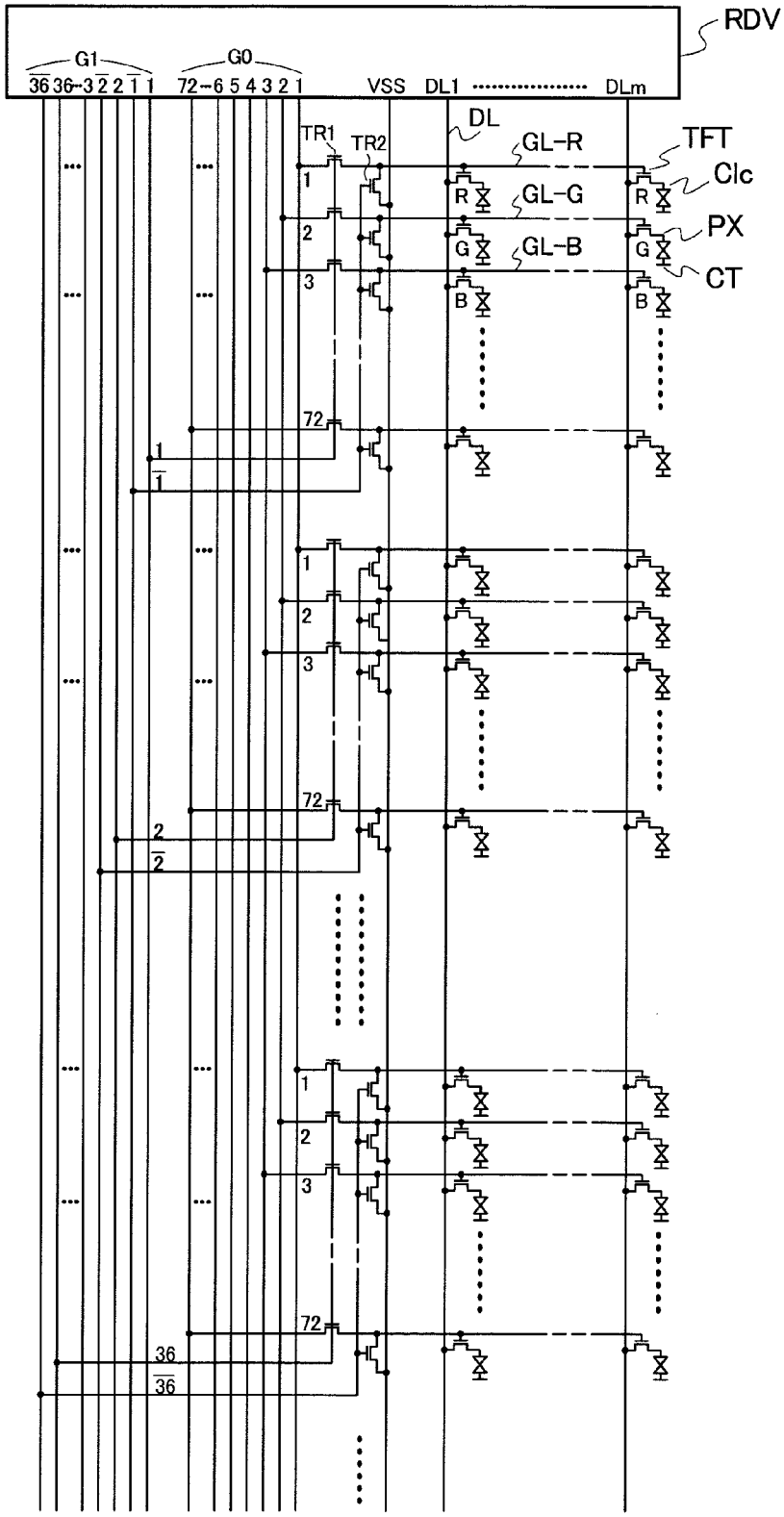
FIG. 3 is a view showing an equivalent circuit of a TFT-type active-matrix liquid crystal display panel of an embodiment 1 of the present invention.

FIG. 3 shows an equivalent circuit of a TFT-type active-matrix liquid crystal display panel according to an embodiment 1 of the present invention.

As shown in FIG. 3, a liquid crystal display panel according to this embodiment includes, on a liquid-crystal-side surface of one substrate of a pair of substrates which are arranged to face each other in an opposed manner with liquid crystal sandwiched therebetween, a plurality of scanning lines (also referred to as "gate lines") (GL-R, GL-G, GL-B) and a plurality of video lines (also referred to as "source lines" or "drain lines") (DL).

Regions surrounded by the scanning lines and the video lines constitute sub pixel regions, and each sub pixel region is provided with a thin film transistor (TFT) which has a gate thereof connected to the scanning line, a drain (or a source) thereof connected to the video line, and the source (or the drain) thereof connected to a pixel electrode (PX) and constitutes an active element.

Since liquid crystal is interposed between the pixel electrode (PX) and a counter electrode (CT), a liquid crystal capacitance (Clc) is formed between the pixel electrode (PX) and the counter electrode (CT). Although a holding capacitance (Cadd) is provided between the pixel electrode (PX) and the counter electrode (also referred to as "common electrode") (CT) in the actual constitution, the description of the holding capacitance (Cadd) is omitted in FIG. 3.

The respective video lines (DL) are connected to a scanning circuit (RDV) which incorporates a horizontal scanning circuit and a vertical scanning circuit therein. The scanning circuit (RDV) outputs video voltages (so-called grayscale voltages) of R, G, B to the video lines (DL) within 1 horizontal scanning period.

In this embodiment, one pixel is constituted of a sub pixel of red (R) which is first color, a sub pixel of green (G) which is second color and a sub pixel of blue (B) which is third color. To the sub pixel of red (R), the sub pixel of green (G) and the sub pixel of blue (B) in one pixel, a video voltage (so-called a grayscale voltage) is inputted via the same video line (DL).

Further, in this embodiment, to the sub pixel of red (R), the sub pixel of green (G) and the sub pixel of blue (B) in one pixel, a scanning voltage is inputted via dedicated scanning lines consisting of the scanning line (GL-R) for R, the scanning line (GL-G) for G and the scanning line (GL-B) for B.

In this manner, in this embodiment, the respective sub pixels of R, G, B are arranged in the order of R→G→B in the extending direction of the video line (D) and, further, the sub pixels of R, G or B are arranged on one straight line respectively in the 1 display line direction (extending direction of the scanning line (G)).

The respective scanning lines (GL-R, GL-G, GL-B) are connected to the scanning circuit (RDV), and the scanning circuit (RDV) sequentially supplies a selection scanning signal to the scanning lines (GL-R, GL-G, GL-B) from top to bottom or from bottom to top.

The liquid crystal display panel of this embodiment is constituted such that the first substrate (also referred to as "TFT substrate", "active matrix substrate") (not shown in the drawing) on which the pixel electrodes, the thin film transistors and the like are formed and the second substrate (also referred to as "counter substrate") (not shown in the drawing) on which color filters and the like are formed overlap with each other with a predetermined gap therebetween, both substrates are adhered to each other by a sealing material formed in a frame shape between peripheral portions of both substrates, liquid crystal is filled and sealed in a space defined between both substrates and inside the sealing material through a liquid crystal filling port formed in a portion of the sealing material, and a polarizer is adhered to outer sides of both substrates.

In this manner, the liquid crystal display panel of this embodiment has the structure where the liquid crystal is sandwiched between the pair of substrates. Further, the counter electrodes are formed on the second substrate (counter substrate) side in case of a TN-type or VA-type liquid crystal display panel, while the counter electrodes are formed on the first substrate (TFT substrate) side in case of an IPS-type liquid crystal display panel.

The present invention is irrelevant to the internal structure of the liquid crystal display panel and hence, the detailed explanation of the internal structure of the liquid crystal display panel is omitted. Further, the present invention is applicable to a liquid crystal display panel having any structure.

Here, the manner of operation of the liquid crystal display panel of this embodiment is explained hereinafter while assuming the number of scanning lines (GL-R, GL-G, GL-B) as 2592 (864×3).

In this embodiment, the scanning lines (GL-R, GL-G, GL-B) are driven using the two-stage constitution. Accordingly, in this embodiment, the scanning lines (GL-R, GL-G, GL-B) are divided into $k_2$ pieces of first groups.

To be more specific, in FIG. 3, the number of scanning lines (GL-R, GL-G, GL-B) belonging to each first group is 72 ($k_1$), and the scanning lines (GL-R, GL-G, GL-B) are divided into 36 pieces ($k_2$ pieces) of first groups. Accordingly, in FIG. 3, the total number of scanning lines (GL-R, GL-G, GL-B) becomes 2592 (2592=36×72).

Accordingly, the scanning circuit (RDV) includes, as terminals for the scanning lines (GL-R, GL-G, GL-B), 72 pieces ($k_1$ pieces) of terminals belonging to a first group (G0-1 to G0-72), and (2×36) pieces ($2k_2$ pieces) of terminals belonging to a second group (G1-1 to G1-36, G1-1(B) to G1-36(B)). Here, among the terminals belonging to the second group, the terminals G1-1 to G1-36 are terminals which output a selective scanning voltage, and terminals G1-1(B) to G1-36(B) are terminals which output a selective reversal scanning voltage. For example, the above-mentioned expressions such as 1(B) and 2(B) are described in a form where a bar symbol is placed above numeral such as 1 or 2 in FIG. 3.

Figure 1:
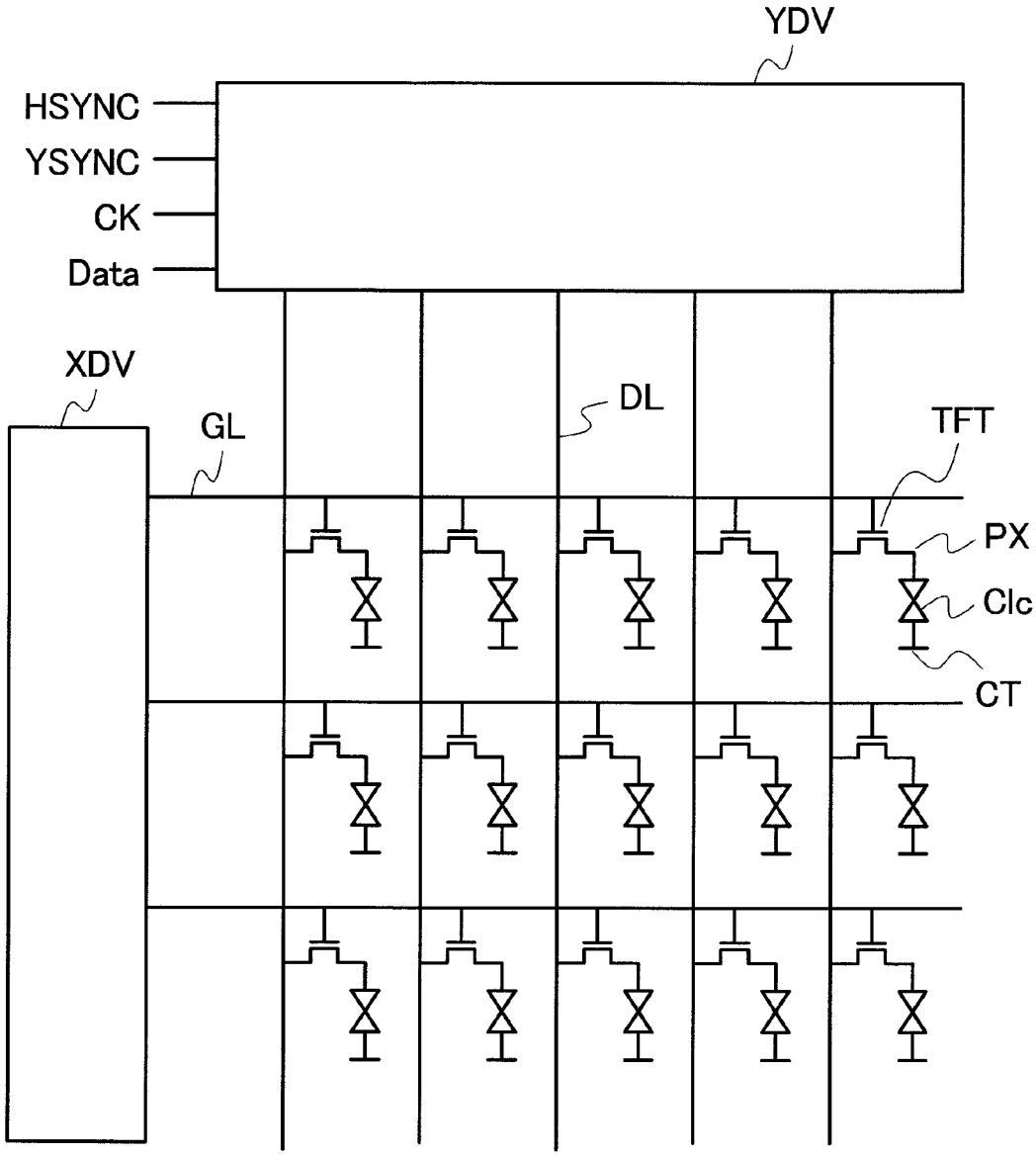
FIG. 1 PRIOR ART
FIG. 1 is a view showing an equivalent circuit of a conventional TFT-type active-matrix liquid crystal display panel.
Figure 2:
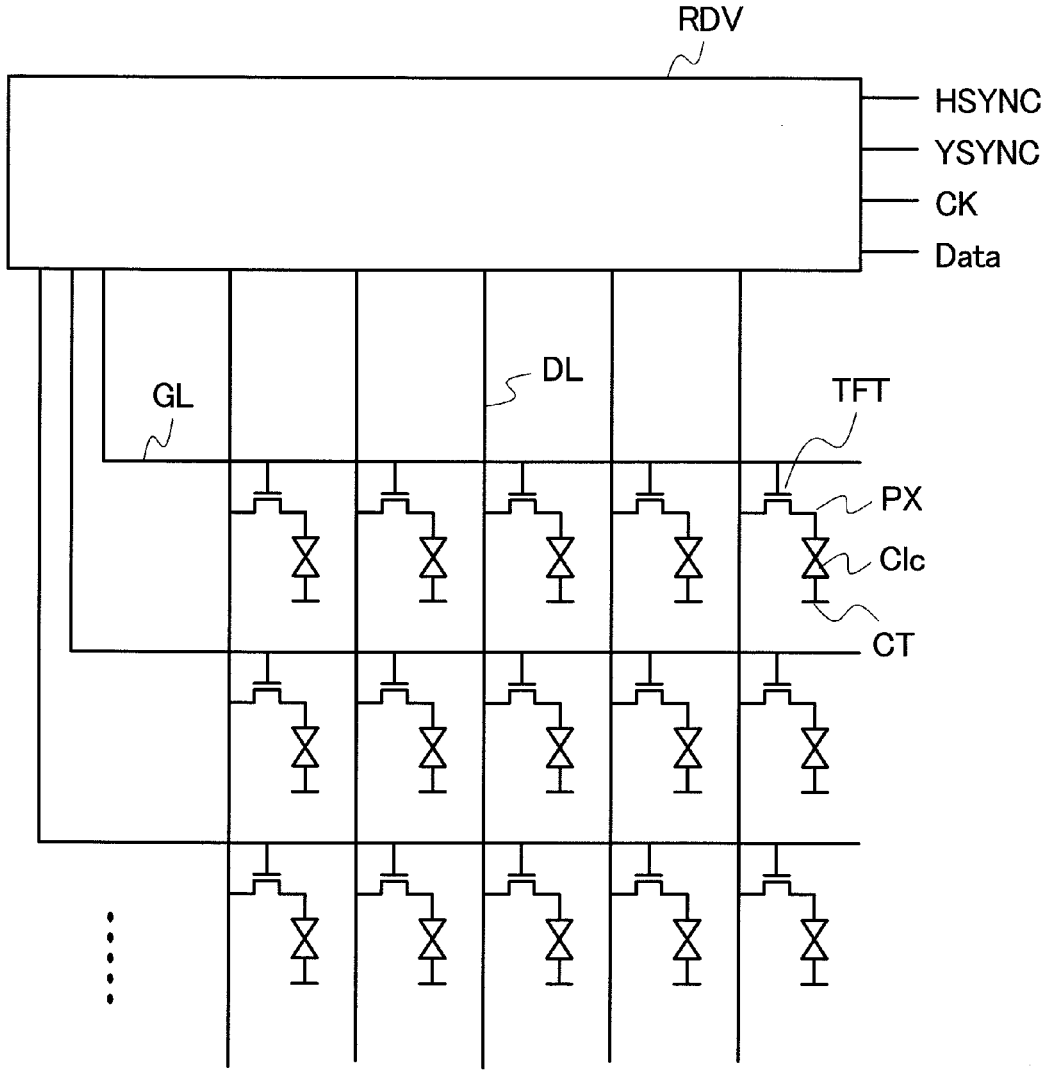
FIG. 2 PRIOR ART
FIG. 2 is a view showing an equivalent circuit of another conventional TFT-type active-matrix liquid crystal display panel.

In FIG. 3, as shown in FIG. 1, the scanning circuit (RDV) may have the circuit constitution consisting of a vertical scanning circuit (XDV) and a horizontal scanning circuit (YDV) which are separate from each other. Here, the scanning circuit (RDV) (or the vertical scanning circuit (XDV) and the horizontal scanning circuit (YDV)) may be constituted of a circuit in a semiconductor chip, and the semiconductor chip may be mounted on one substrate of the pair of substrates which constitute the liquid crystal display panel.

Alternatively, the scanning circuit (RDV), the vertical scanning circuit (XDV), or the horizontal scanning circuit (YDV) may be constituted of a poly-Si thin film transistor, and these circuits may be formed on a liquid-crystal-side surface of one substrate of the pair of substrates which constitute the liquid crystal display panel.

Figure 4:
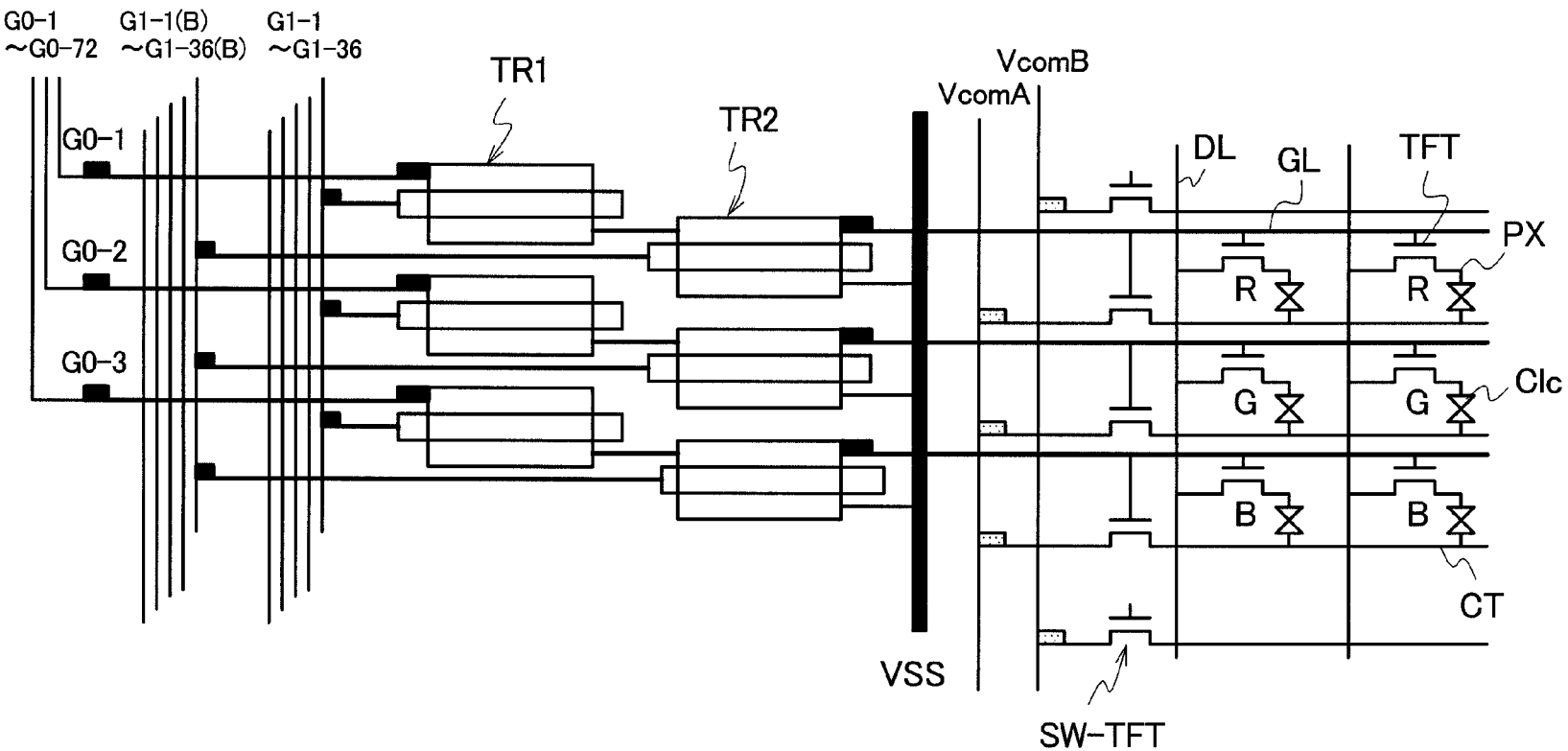
FIG. 4 is a view showing an arrangement state of a first transistor (TR1) and a second transistor (TR2) shown in FIG. 3.
Figure 5:
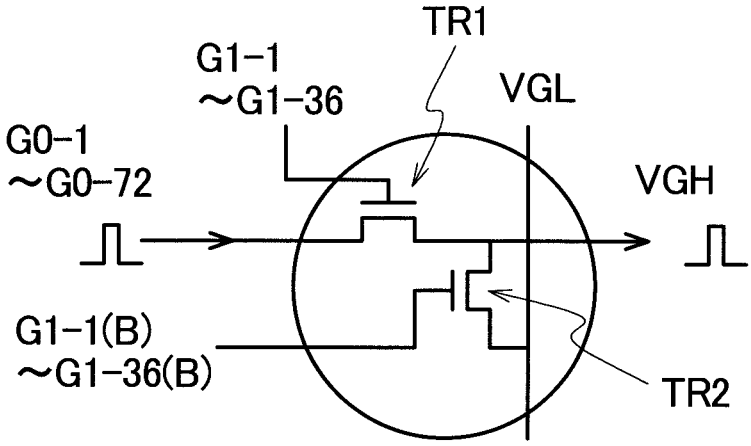
FIG. 5 is a view showing an equivalent circuit of the first transistor (TR1) and the second transistor (TR2) shown in FIG. 3.

FIG. 4 shows an arrangement state of a first transistor (TR1) and a second transistor (TR2) shown in FIG. 3, and FIG. 5 shows an equivalent circuit of the first transistor (TR1) and the second transistor (TR2) shown in FIG. 3.

In this embodiment, one end of each scanning line (GL-R, GL-G, GL-B) is connected to a second electrode (a drain or a source) of the first transistor (TR1).

Further, between each scanning line (GL-R, GL-G, GL-B) and a reference potential (voltage VSS whose voltage level is a LOW level (hereinafter referred to as "L level")), the second transistor (TR2) which prevents the scanning line (GL-R, GL-G, GL-B) from assuming a floating state when a non-selective scanning voltage is supplied to each scanning line (GL-R, GL-G, GL-B) is connected.

A first electrode (a source or a drain) of the first transistor (TR1) is connected to any one of gate lines which are connected to the terminals belonging to the first group (G0-1 to G0-72). Further, a gate of the first transistor (TR1) is connected to any one of gate lines connected to terminals (G1-1 to G1-36) among the terminals belonging to the second group.

Further, a gate of the second transistor (TR2) is connected to any one of reverse gate lines connected to terminals (G1-1(B) to G1-36(B)) which output a selective reversal scanning voltage among the terminals belonging to the second group.

In FIG. 4, outside a display region where the pixels are arranged in a matrix array, a switching element (SW-TFT) is provided between the counter electrode (CT) and a common counter electrode line. A switching element (SW-TFT) is constituted of a poly-Si thin film transistor, for example.

A gate of the switching element (SW-TFT) is connected to each scanning line (GL-R, GL-G, GL-B), and a counter voltage VcomA or VcomB is inputted to the counter electrode (CT) when the scanning line is selected. A positive counter voltage and a negative counter voltage are outputted to the terminals VcomA and VcomB respectively. Here, when a positive counter voltage is outputted to the terminal VcomA, a negative counter voltage is outputted to the terminal VcomB, while when a negative counter voltage is outputted to the terminal VcomA, a positive counter voltage is outputted to the terminal VcomB.

Accordingly, it is possible to realize 1 line reversal drive method as a method of driving the liquid crystal display panel while maintaining an AC cycle of a common counter electrode line as 1 frame period. Further, by providing the switching element (SW-TFT), the capacitance of only one counter electrode is merely driven at the time of selecting each counter electrode (CT) and hence, 1 line reversal driving can be realized while maintaining the current consumption at the time of driving the counter electrode at a low level in a driver (scanning circuit (RDV), vertical scanning circuit (XDV) or horizontal scanning circuit (YDV)) for driving the liquid crystal display panel.

Figure 6:
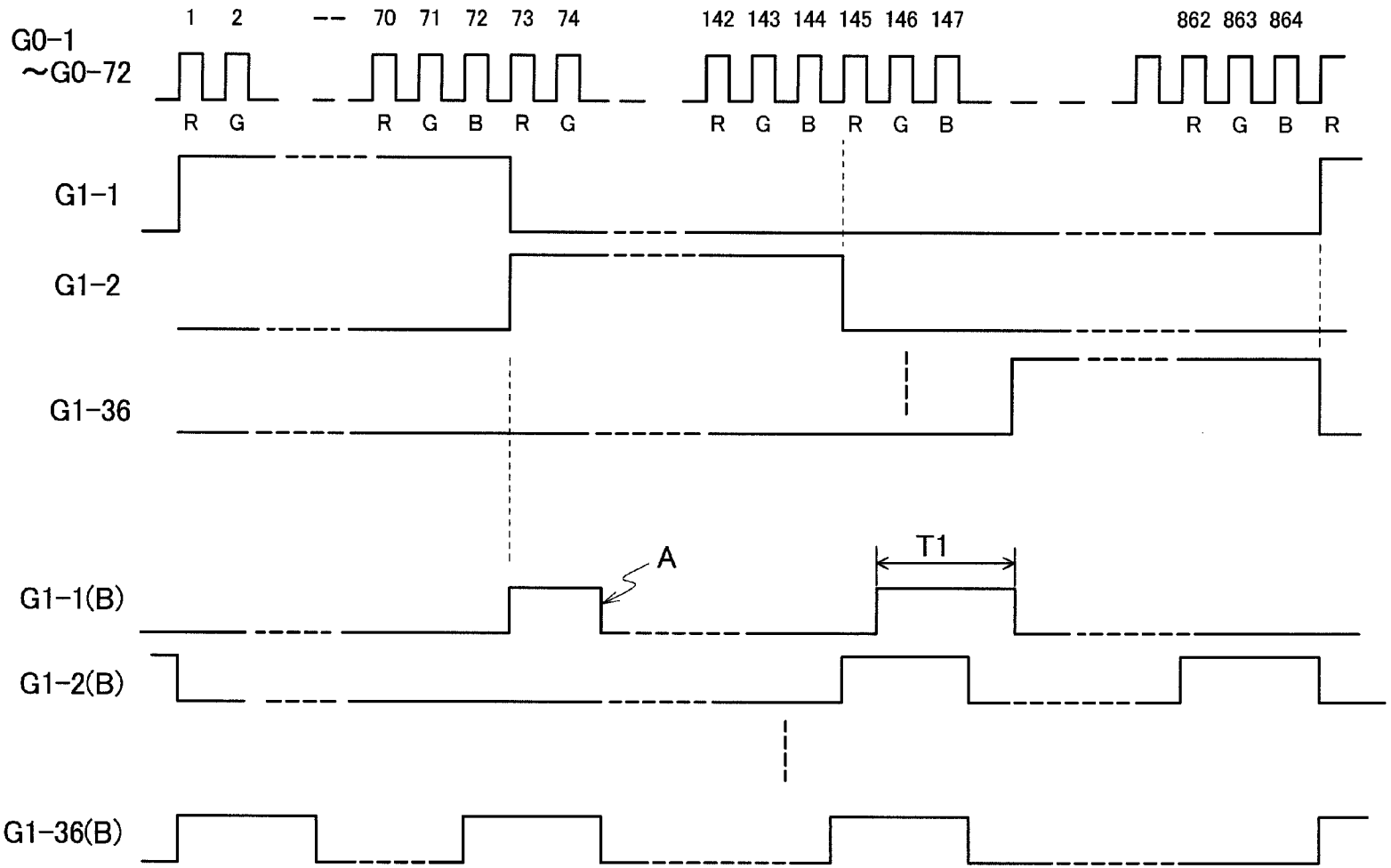
FIG. 6 is a timing chart for explaining a drive method of the TFT-type active-matrix liquid crystal display panel of the embodiment 1 of the present invention.

FIG. 6 is a timing chart for explaining a drive method of the TFT-type active-matrix liquid crystal display panel of this embodiment. With respect to a pulse column described as G0-1 to G0-72 in the drawing, the pulses are shown on the same column in FIG. 6. However, in an actual operation, G0-1 to G0-72 indicate independent single pulses which are outputted from respective terminals G0-1, G0-2, G0-3. In the explanation made hereinafter, a scanning period during which the video voltage is inputted to one row of pixels is set as 1 horizontal scanning period. That is, a period during which three sub pixel rows consisting of a sub pixel row of red (R), a sub pixel row of green (G) and a sub pixel row of blue (B) shown in FIG. 3 and FIG. 4 are scanned is set as 1 horizontal scanning period. This 1 horizontal scanning period is described as H.

As shown in FIG. 6, the scanning circuit (RDV) sequentially outputs a selective scanning voltage of High level (hereinafter referred to as "H level") to the terminals G0-1 to G0-72 which constitute the terminals belonging to the first group for every H/3 (72 digit decimal system).

Further, the scanning circuit (RDV) sequentially outputs a selective scanning voltage of H level to the terminals G1-1 to G1-36 among the terminals belonging to the second group for every 24H period (72H/3) (24 digit decimal system). When a selective scanning voltage of H level is outputted to the selected terminals among the terminals belonging to the second group, a first transistor (TR1) whose gate is connected to the gate line connected to the selected terminal is turned on.

When a selective scanning voltage of H level is outputted from the terminals selected among the terminals (G0-1 to G0-72) belonging to the first group in such a state, the thin film transistors (active elements) (TFT) whose gates are connected to the scanning lines (GL-R, GL-G, GL-B) to which the selective scanning voltage is supplied are turned on so that a video voltage is written in the pixel electrodes via the thin film transistors (TFT) whereby an image is displayed on the liquid crystal display panel.

That is, the respective terminals belonging to the second group sequentially output the selective scanning voltage of H level to 74 pieces of the scanning lines (GL-R, GL-G, GL-B) in bundle for every 24H period.

For example, during a period in which the selective scanning voltage of High level (hereinafter referred to as "H level") is outputted from the terminal G1-1, 72 pieces of single pulses G0-1 to G0-72 are inputted parallel to each other into the respective first transistors (TR1) formed in the first piece of first group among 36 pieces of first groups. During a period in which the selective scanning voltage of H level is outputted from the terminal G1-2, 72 pieces of single pulses G0-1 to G0-72 are inputted parallel to each other into the respective first transistors (TR1) formed in the second piece of first group among 36 pieces of first groups.

Finally, during a period in which the selective scanning voltage of H level is outputted from the terminal G1-36, 72 pieces of single pulses G0-1 to G0-72 are inputted parallel to each other into the respective first transistors (TR1) formed in the 36th piece of the first group among 36 pieces of first groups. Accordingly, the selective scanning voltage (voltage indicated by VGH in FIG. 5) is sequentially outputted to the 2592 pieces of scanning lines (GL-R, GL-G, GL-B).

Here, a non-selective reversal scanning voltage of L level is outputted from terminals corresponding to the selected terminals among the terminals G1-1(B) to G1-36(B) belonging to the second group.

When the non-selective reversal scanning voltage of L level is outputted from the terminals corresponding to the selected terminals, the second transistor (TR2) whose gate is connected to a reverse gate line which is connected to the terminal to which the non-selective reversal scanning voltage of L level is outputted is turned off.

Accordingly, the first transistors (TR1) belonging to the selected group among 36 pieces of the first groups are turned on, and the second transistors (TR2) belonging to the selected group are turned off. In the remaining non-selected groups, any one of the second transistors (TR2) is turned on and hence, the scanning lines (GL-R, GL-G, GL-B) assume the L level (=VSS). In this embodiment, the scanning lines (GL-R, GL-G, GL-B) are sequentially selected in the above-mentioned manner.

In this embodiment, the number of gate lines and the number of reverse gate lines which connect the terminals (G0-1 to G0-72) belonging to the first group, the terminals (G1-1 to G1-36, G1-1(B) to G1-36(B)) belonging to the second group and the scanning lines (GL-R, GL-G, GL-B) are 72, 72 (36×2) respectively, that is, are equal to each other. Here, the total number of gate lines becomes 144 (72+72). That is, although 2592 pieces of gate lines are necessary when all scanning lines (GL-R, GL-G, GL-B) are connected to the scanning circuit (RDV) using the gate lines on a one-to-one basis, the number of gate lines can be reduced to 144 pieces in this embodiment.

In the related art, a reverse voltage of a signal inputted to the gate of the first transistor (TR1) is inputted to a gate of the second transistor (TR2). Further, a selective scanning voltage of H level is inputted to the gate of the first transistor (TR1) only in 1H period during 1 frame period and hence, a selective reversal scanning voltage of H level is inputted to the gate of the second transistor (TR2) during the most of 1 frame period.

As described previously, it has been reported that, with respect to an operational lifetime of the thin film transistor, the magnitude of a stress is defined based on a potential difference between a gate and a source or between the gate and a drain and a potential difference applying time, and an ON current of the thin film transistor is lowered or a threshold value is shifted due to this stress.

In the manner of operation of the second transistor (TR2) of the related art described previously, a duty ratio of a selective reversal scanning voltage of H level applied to the gate of the second transistor (TR2) is large. Accordingly, there exists a possibility that the characteristic of the thin film transistor is changed with time and this change of characteristic deteriorates the reliability of a product panel.

Lowering of the duty ratio of the selective reversal scanning voltage of H level inputted to the gate of the second transistor (TR2) is effective in prolonging the lifetime of the second transistor (TR2). According to the present invention, the duty ratio of the selective reversal scanning voltage of H level inputted to the gate of the second transistor (TR2) is regulated to 5% or more and 50% or less.

For this end, according to this embodiment, as shown in FIG. 6, in inputting the non-selective scanning voltage of L level to the gate of the first transistor (TR1) in each group, a reversal scanning voltage of H level is intermittently inputted to the gate of the second transistor (TR2) in the corresponding group as indicated by symbol A in FIG. 6.

In this manner, according to this embodiment, by intermittently inputting the selective reversal scanning voltage of H level to the gate of the second transistor (TR2), the scanning lines (GL-R, GL-G, GL-B) assume a floating state during a period in which the non-selective scanning voltage of L level is inputted to the gate of the second transistor (TR2).

Accordingly, by being influenced by a change of a video voltage supplied to the video line (DL), voltages of the scanning lines (GL-R, GL-G, GL-B) in a floating state rise so that the thin film transistors (TFT) which have gates thereof connected to the scanning lines (GL-R, GL-G, GL-B) in a floating state are turned on thus giving rise to a possibility that the video voltage is written in an image on pixels other than the selected pixels.

To prevent such a phenomenon, the respective terminals G0-1 to G0-72 sequentially output a selective scanning voltage of H level during a period in which the respective first transistors (TR1) in the first group are in an ON state and, thereafter, output a non-selective scanning voltage of L level. Due to such an operation, the respective first transistors (TR1) in the first group are turned off after all scanning lines (GL-R, GL-G, GL-B) which are connected to the respective first transistors (TR1) in the first group are fixed to L level.

Although the respective first transistors (TR1) in the first group are turned off and the scanning lines (GL-R, GL-G, GL-B) assume a floating state so that the voltages of the scanning lines (GL-R, GL-G, GL-B) are prone to rise, the selective reversal scanning voltage of H level is intermittently inputted to the gates of the second transistors (TR2) and hence, the scanning lines (GL-R, GL-G, GL-B) are maintained at L level.

In this embodiment, a period in which the selective reversal scanning voltage of H level is inputted to the gates of the second transistors (TR2) during 1 frame period (Ton: period formed by adding all periods T1 shown in FIG. 6 during 1 frame period) is set to 5% or more and 50% or less of a period (Toff) during which the non-selective reversal scanning voltage of L level is inputted to the gates of the second transistors (TR2) during 1 frame period.

That is, as described previously, the duty ratio of the selective reversal scanning voltage inputted to the gates of the second transistors (TR2) is set to 5% or more and 50% or less.

Embodiment 2

Figure 7:
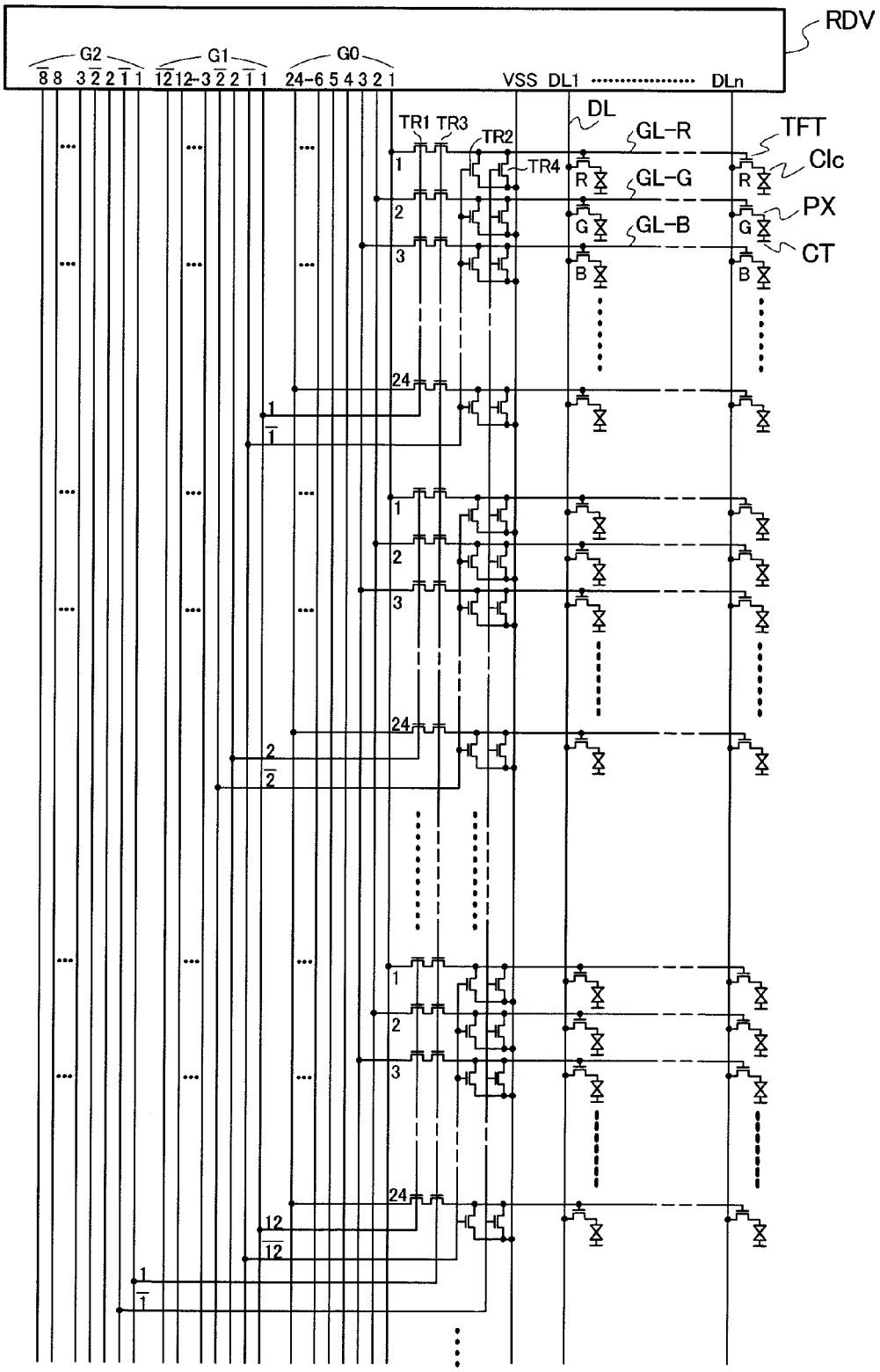
FIG. 7 is a view showing an equivalent circuit of a TFT-type active-matrix liquid crystal display panel of an embodiment 2 of the present invention.

FIG. 7 shows an equivalent circuit of a TFT-type active-matrix liquid crystal display panel according to an embodiment 2 of the present invention.

In this embodiment, the scanning lines (GL-R, GL-G, GL-B) are driven using the three-stage constitution. In this embodiment, the scanning lines (GL-R, GL-G, GL-B) are divided into $k_2 \times k_3$ pieces of first groups. Each second group includes $k_2$ pieces of first groups, and each third group includes $k_3$ pieces of second groups.

To be more specific, in FIG. 7, the third group includes 9 pieces ($k_3$ pieces) of second groups, the second group includes 12 pieces ($k_2$ pieces) of first groups, and the first group includes 24 pieces ($k_1$ pieces) of scanning lines (GL-R, GL-G, GL-B). Accordingly, in FIG. 7, the total number of scanning lines (GL-R, GL-G, GL-B) becomes 2592 ($2592=24\times12\times9$).

Accordingly, the scanning circuit (RDV) includes, as terminals for the scanning lines (GL-R, GL-G, GL-B), 24 pieces ($k_1$ pieces) of terminals belonging to the first group (G0-1 to G0-24), ($2\times24$) pieces ($2k_2$ pieces) of terminals belonging to the second group (G1-1 to G1-12, G1-1(B) to G1-12(B)), and ($2\times9$) pieces ($2k_3$ pieces) of terminals belonging to the third group (G2-1 to G2-9, G2-1(B) to G2-9(B)).

In this embodiment, the number of gate lines and the number of reverse gate lines which connect the terminals (G0-1 to G0-24) belonging to the first group, the terminals (G1-1 to G1-12, G1-1(B) to G1-12(B)) belonging to the second group, and the terminals (G2-1 to G2-9, G2-1(B) to G2-9(B)) belonging to the third group with the scanning lines (GL-R, GL-G, GL-B) are 24, 24 ($12\times2$), 18($9\times2$) respectively, that is, become substantially equal to each other. Here, the total number of gate lines becomes 66 (24+24+18). That is, although 2592 pieces of gate lines are necessary when all scanning lines (GL-R, GL-G, GL-B) are connected to the scanning circuit (RDV) using the gate lines on a one-to-one basis, the number of gate lines can be reduced to 66 pieces in this embodiment.

Further, in this embodiment, although the number of transistors is increased from 2 to 4 with respect to 1 scanning line compared to the embodiment 1, the number of gate lines becomes half or less of the number of gate lines used in the embodiment 1 ($144\rightarrow66$) instead.

In this manner, the trade-off relationship is established between the number of transistors and the number of gate lines. As in the case of a liquid crystal display panel which uses an a-Si thin film transistor as an active element or the like, when the performance necessary for rising or falling the scanning lines (GL-R, GL-G, GL-B) cannot be acquired unless a size of the transistor is increased, the number of transistors can be reduced in the above-mentioned embodiment 1 compared to this embodiment and hence, even when the number of gate lines is increased, a total area of the circuit can be made small so that the embodiment 1 is more effective.

Figure 8:
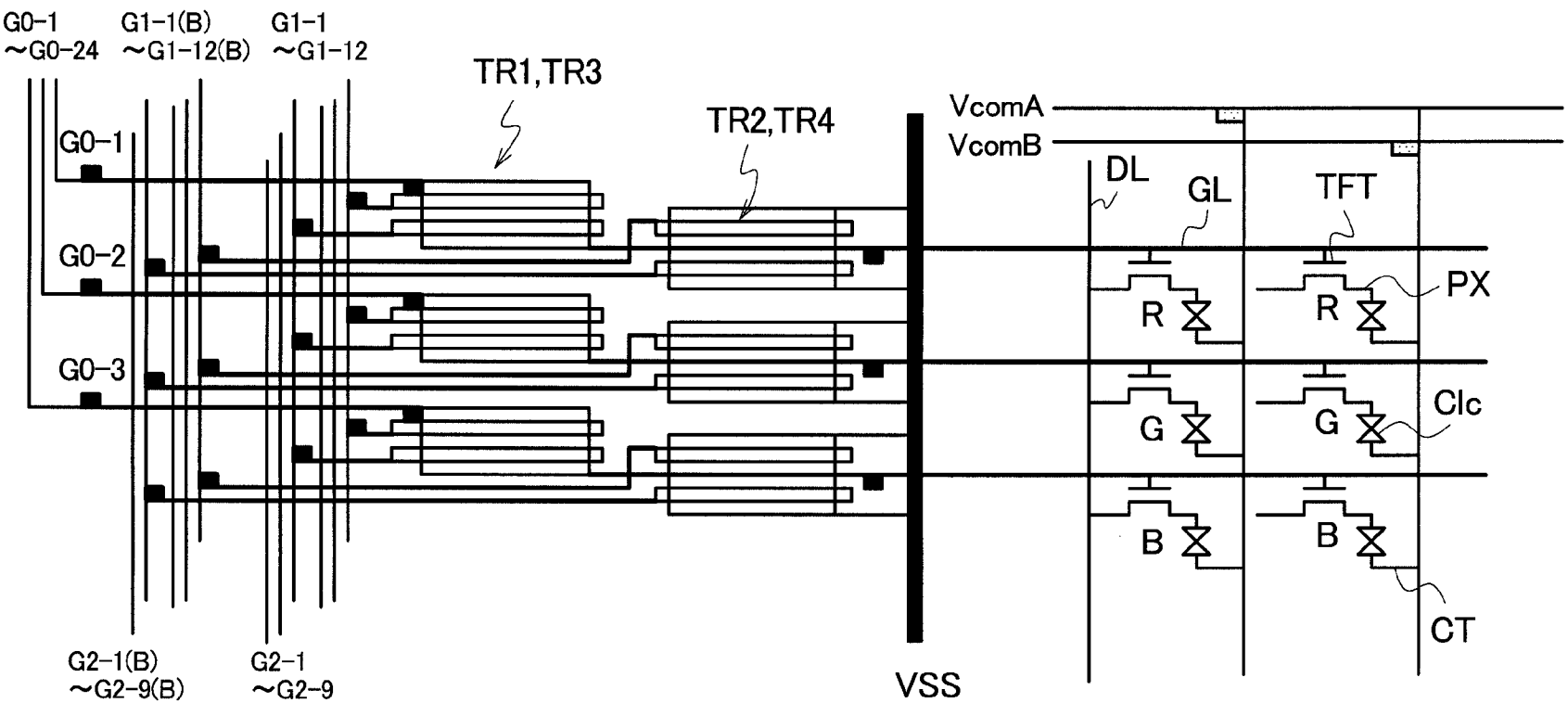
FIG. 8 is a view showing an arrangement state of a first transistor (TR1) to a fourth transistor (TR4) shown in FIG. 7.
Figure 9:
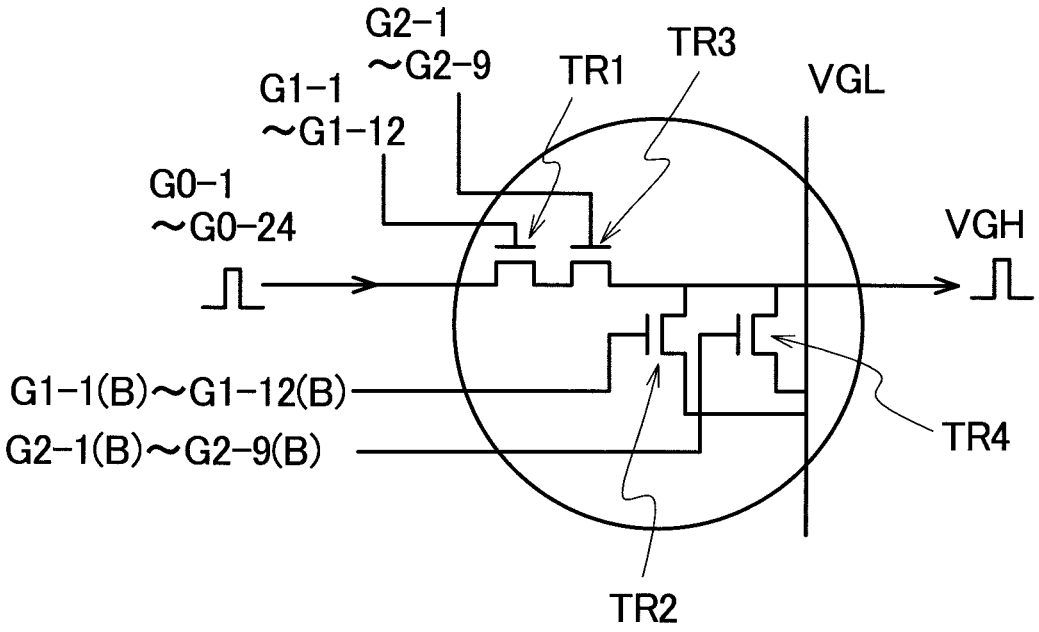
FIG. 9 is a view showing an equivalent circuit of the first transistor (TR1) to the fourth transistor (TR4) shown in FIG. 7.

FIG. 8 shows an arrangement state of the first transistor (TR1) to the fourth transistor (TR4) shown in FIG. 7, and FIG. 9 shows an equivalent circuit of a first transistor (TR1) to a fourth transistor (TR4) shown in FIG. 7.

In this embodiment, one end of each scanning line (GL-R, GL-G, GL-B) is connected to a second electrode (drain or source) of the third transistor (TR3), and a first electrode (source or drain) of the third transistor (TR3) is connected to a second electrode of the first transistor (TR1).

Further, between each scanning line (GL-R, GL-G, GL-B) and a reference potential (voltage VSS whose voltage level is a LOW level (hereinafter referred to as "L level")), a second transistor (TR2) and a fourth transistor (TR4) which prevent the scanning line (GL-R, GL-G, GL-B) from assuming a floating state when a non-selective scanning voltage is supplied to each scanning line (GL-R, GL-G, GL-B) are connected.

A first electrode (a source or a drain) of the first transistor (TR1) is connected to any one of gate lines which are connected to the terminals belonging to the first group (G0-1 to G0-24). Further, a gate of the first transistor (TR1) is connected to any one of gate lines connected to terminals (G1-1 to G1-12) among the terminals belonging to the second group. Further, a gate of the third transistor (TR3) is connected to any one of gate lines connected to terminals (G2-1 to G2-9) among the terminals belonging to the third group.

Further, a gate of the second transistor (TR2) is connected to any one of the reverse gate lines connected to terminals (G1-1(B) to G1-12(B)) which output a selective reversal scanning voltage among the terminals belonging to the second group. Further, a gate of the fourth transistor (TR4) is connected to any one of reverse gate lines connected to terminals (G2-1(B) to G2-9(B)) which output a selective reversal scanning voltage among the terminals belonging to the third group.

In FIG. 7, the scanning circuit (RDV) may have the circuit constitution consisting of a vertical scanning circuit (XDV) and a horizontal scanning circuit (YDV) which are separate from each other as shown in FIG. 1. Here, the scanning circuit (RDV) (or the vertical scanning circuit (XDV) and the horizontal scanning circuit (YDV)) may be constituted of a circuit in a semiconductor chip, and the semiconductor chip may be mounted on one substrate of a pair of substrates which constitute a liquid crystal display panel.

Alternatively, the scanning circuit (RDV), the vertical scanning circuit (XDV), or the horizontal scanning circuit (YDV) may be constituted of a poly-Si thin film transistor, and these circuits may be formed on a liquid-crystal-side surface of one substrate of the pair of substrates which constitute the liquid crystal display panel.

Further, in FIG. 8, symbols VcomA and VcomB are output terminals for supplying counter voltages to the counter electrode (CT). When a positive counter voltage is outputted to the terminal VcomA, a negative counter voltage is outputted to the terminal VcomB, while when a negative counter voltage is outputted to the terminal VcomA, a positive counter voltage is outputted to the terminal VcomB.

Figure 10:
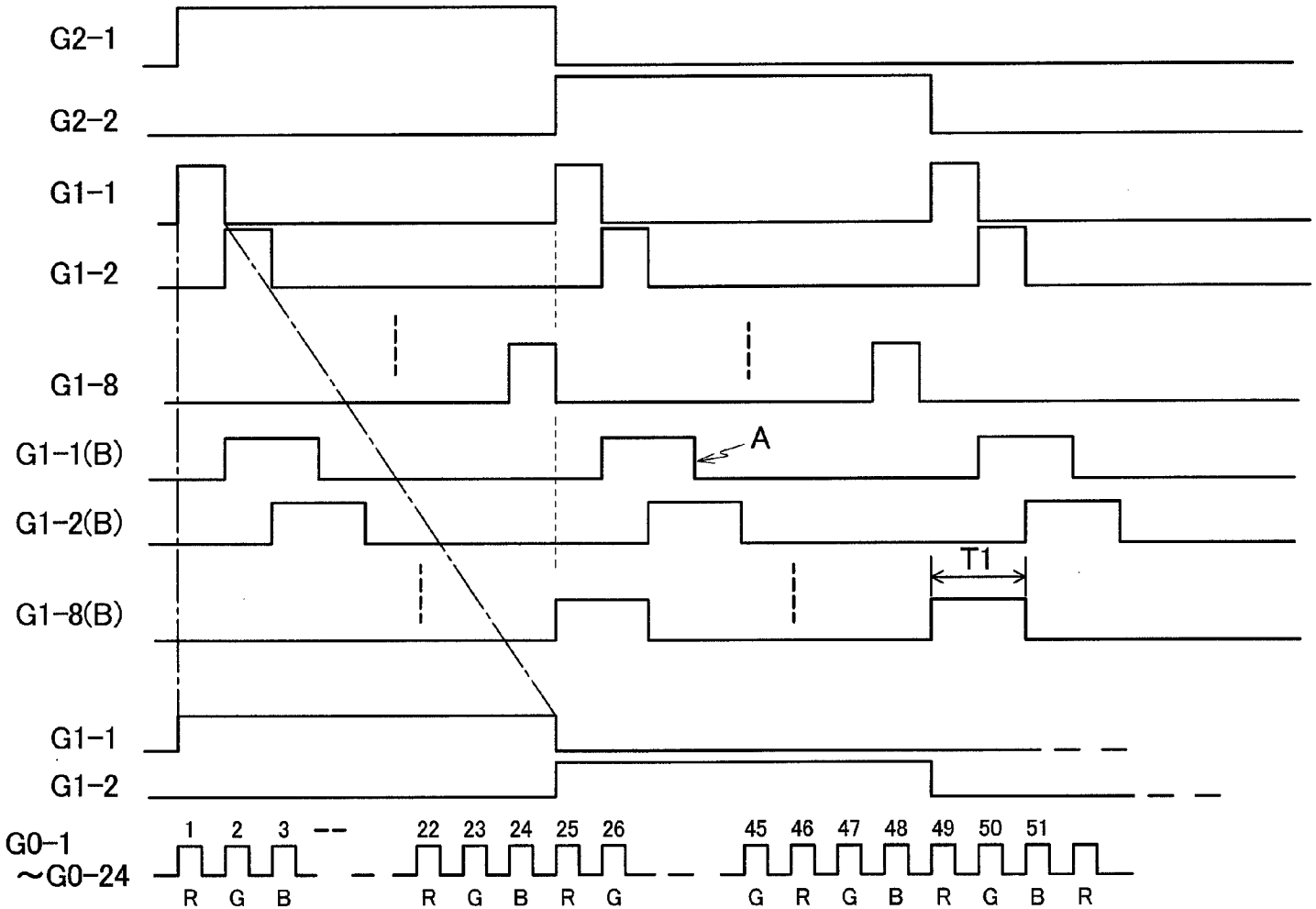
FIG. 10 is a timing chart for explaining a drive method of a TFT-type active-matrix liquid crystal display panel of the embodiment 2 of the present invention.

FIG. 10 is a timing chart for explaining a drive method of the TFT-type active-matrix liquid crystal display panel of this embodiment. With respect to a pulse column described as G0-1 to G0-24 in the drawing, the pulses are shown on the same column in FIG. 10. However, in an actual operation, G0-1 to G0-24 indicate independent single pulses which are outputted from respective terminals G0-1, G0-2, G0-3.

As shown in FIG. 10, the scanning circuit (RDV) sequentially outputs a selective scanning voltage of High level (hereinafter referred to as "H level") to the terminals G0-1 to G0-24 which constitute the terminals belonging to the first group for every H/3 (24 digit decimal system).

Further, the scanning circuit (RDV) sequentially outputs a selective scanning voltage of H level to the terminals G1-1 to G1-12 among the terminals belonging to the second group for every 8H period (24H/3) (8 digit decimal system). When a selective scanning voltage of H level is outputted to the selected terminals among the terminals belonging to the second group, a first transistor (TR1) whose gate is connected to the gate line connected to the selected terminal is turned on.

Further, the scanning circuit (RDV) sequentially outputs a selective scanning voltage of H level to the terminals G2-1 to G2-9 among the terminals belonging to the third group for every 96H period (9 digit decimal system). When a selective scanning voltage of H level is outputted to the selected terminals among the terminals belonging to the third group, a third transistor (TR3) whose gate is connected to the gate line connected to the selected terminal is turned on.

Accordingly, when a selective scanning voltage of H level is outputted from the terminals selected among the terminals belonging to the first group, the thin film transistors (active elements) (TFT) whose gates are connected to the scanning lines (GL-R, GL-G, GL-B) to which the selective scanning voltage is supplied are turned on so that a video voltage is written in the pixel electrodes via the thin film transistors (TFT) whereby an image is displayed on the liquid crystal display panel.

That is, the respective terminals belonging to the second group sequentially output the selective scanning voltage of H level to 24 pieces of the scanning lines (GL-R, GL-G, GL-B) in bundle for every 8H period. The respective terminals belonging to the third group sequentially output the selective scanning voltage of H level to 288 pieces of the scanning lines (GL-R, GL-G, GL-B) in bundle for every 96H period.

For example, during a period in which the selective scanning voltage of H level is outputted from the terminal G1-1 and the terminal G2-1, 24 pieces of single pulses G0-1 to G0-24 are inputted in parallel into the respective first transistors (TR1) in the first group. During a period in which the selective scanning voltage of H level is outputted from the terminal G1-2 and the terminal G2-1, 24 pieces of single pulses G0-1 to G0-24 are inputted in parallel into the respective first transistors (TR1) in the second group.

Finally, during a period in which the selective scanning voltage of H level is outputted from the terminal G1-12 and the terminal G2-1, 24 pieces of single pulses G0-1 to G0-24 are inputted in parallel into the respective first transistors (TR1) in the twelfth group. Accordingly, the selective scanning voltage (voltage indicated by symbol VGH in FIG. 9) is sequentially outputted to the 2592 pieces of scanning lines (GL-R, GL-G, GL-B).

Here, a non-selective reversal scanning voltage of L level is outputted from terminals corresponding to the selected terminals among the terminals G1-1(B) to G1-12(B) belonging to the second group and the terminals G2-1(B) to G2-9(B) belonging to the third group.

When the non-selective reversal scanning voltage of L level is outputted from the terminals corresponding to the selected terminals, the second transistor (TR2) and the fourth transistor (TR4) whose gates are connected to a reverse gate line which is connected to the terminal to which the non-selective reversal scanning voltage of L level is outputted are turned off.

Accordingly, the first transistors (TR1) and the third transistors (TR3) belonging to the selected group among 108 pieces of the groups are turned on, and the second transistors (TR2) and the fourth transistors (TR4) belonging to the selected group are turned off. In the remaining groups, either one of the second transistors (TR2) and the fourth transistors (TR4) is turned on and hence, the scanning lines (GL-R, GL-G, GL-B) assume the L level (=VSS). In this embodiment, the scanning lines (GL-R, GL-G, GL-B) are sequentially selected in the above-mentioned manner.

Also in this embodiment, as shown in FIG. 10, when a non-selective scanning voltage of L level is inputted to a gate of the first transistor (TR1) in each group, a selective reversal scanning voltage of H level is intermittently inputted to a gate of the second transistor (TR2) in the group as indicated by A in FIG. 10. In the same manner, when a non-selective scanning voltage of L level is inputted to a gate of the third transistor (TR3) in each group, a selective reversal scanning voltage of H level is intermittently inputted to a gate of the fourth transistor (TR4) in the group.

Also in this embodiment, to prevent a phenomenon where voltages of the scanning lines (GL-R, GL-G, GL-B) in a floating state rise by being influenced by a change in a video voltage supplied to the video line (DL) so that the thin film transistors (TFT) whose gates are connected to the scanning lines (GL-R, GL-G, GL-B) in a floating state are turned on whereby a video voltage is written in an image other than selected pixels, the respective terminals G0-1 to G0-24 sequentially output a selective scanning voltage of H level during a period in which each first transistor (TR1) and each third transistor (TR3) in the first group assume an ON state and, thereafter, the respective terminals G0-1 to G0-24 outputs a non-selective scanning voltage which is at L level. Accordingly, each first transistor (TR1) and each third transistor (TR3) in the first group are turned off after all scanning lines (GL-R, GL-G, GL-B) which are connected to a serial circuit of each first transistor (TR1) and each third transistor (TR3) in the first group are fixed to L level.

Although the respective first transistors (TR1) and the respective third transistors (TR3) in the first group are turned off and the scanning lines (GL-R, GL-G, GL-B) assume a floating state so that the voltages of the scanning lines (GL-R, GL-G, GL-B) are prone to rise, the selective reversal scanning voltage of H level is intermittently inputted to the gates of the second transistors (TR2) and the fourth transistors (TR4) and hence, the scanning lines (GL-R, GL-G, GL-B) are maintained at L level.

Also in this embodiment, a period during which the selective reversal scanning voltage of H level is inputted to the gates of the second transistors (TR2) during 1 frame period (Ton: period formed by adding all periods T1 shown in FIG. 10 during 1 frame period) is set to 5% or more and 50% or less of a period (Toff) during which the non-selective reversal scanning voltage of L level is inputted to the gates of the second transistors (TR2) during 1 frame period.

That is, as described previously, a duty ratio of the selective reversal scanning voltage of H level inputted to the gates of the second transistors (TR2) is set to 5% or more and 50% or less.

Although the explanation is made with respect to a case where the scanning lines (GL-R, GL-G, GL-B) are driven by three-stage constitution in this embodiment, the scanning lines (GL-R, GL-G, GL-B) may be driven by four-or-more stage constitution.

Embodiment 3

Figure 11:
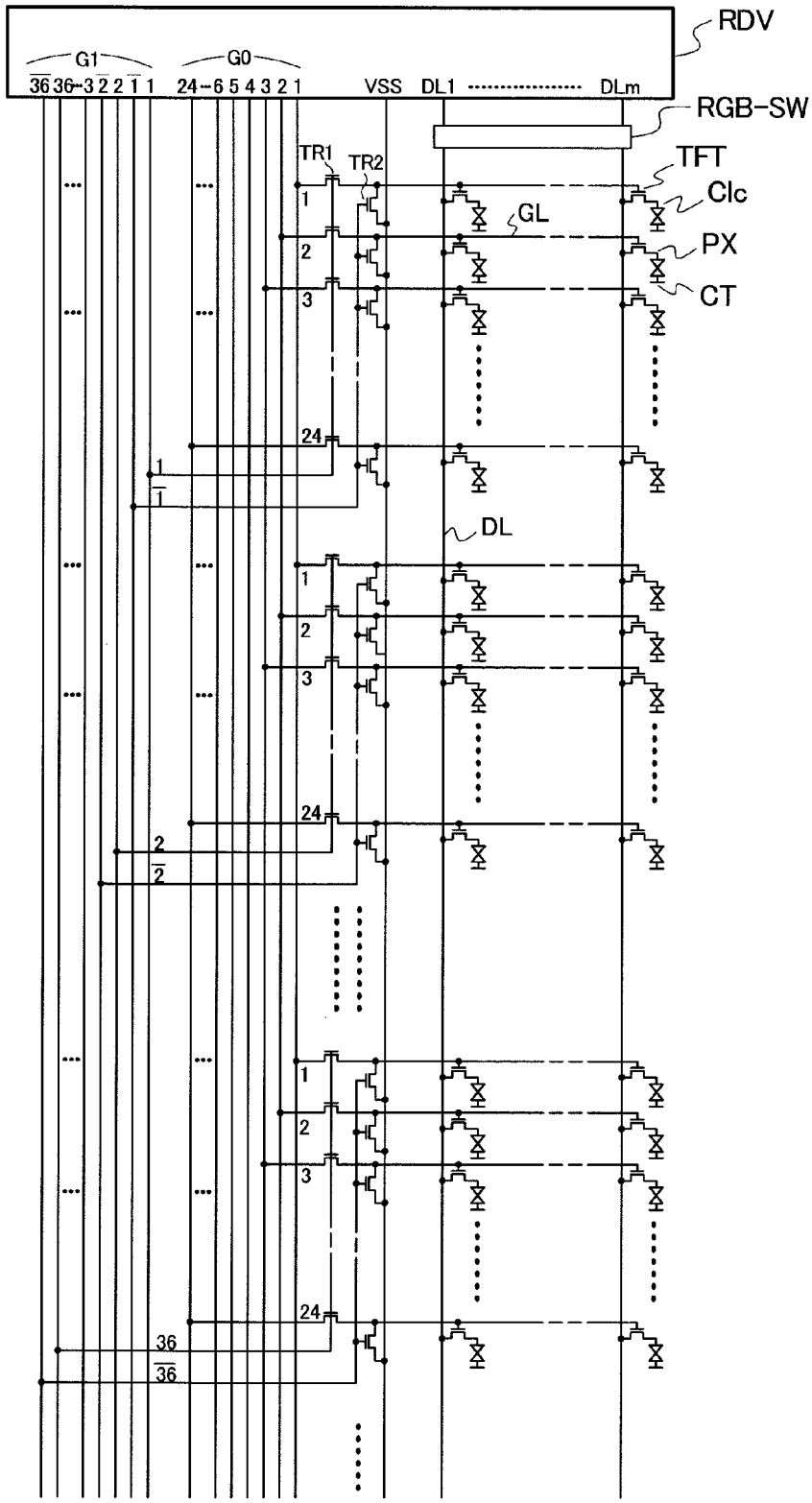
FIG. 11 is a timing chart for explaining a drive method of the TFT-type active-matrix liquid crystal display panel of an embodiment 3 of the present invention.
Figure 12:
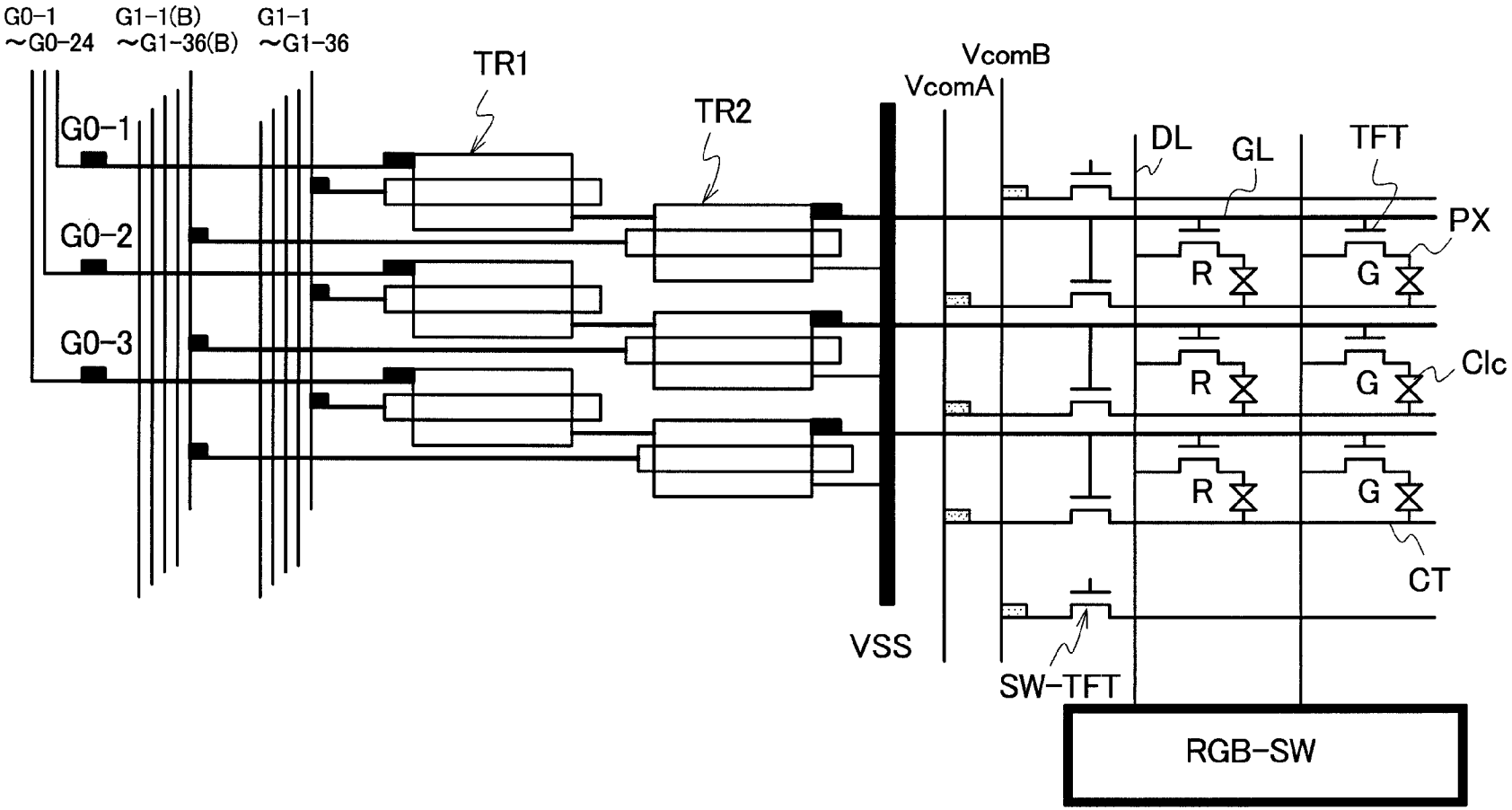
FIG. 12 is a view showing an arrangement state of a first transistor (TR1) and a second transistor (TR2) shown in FIG. 11.

FIG. 11 shows an equivalent circuit of a TFT-type active-matrix liquid crystal display panel according to an embodiment 3 of the present invention. FIG. 12 shows an arrangement state of first transistors (TR1) and second transistors (TR2) shown in FIG. 11.

Also in this embodiment, one pixel is constituted of a sub pixel of red (R) which is first color, a sub pixel of green (G) which is second color and a sub pixel of blue (B) which is third color. However, in this embodiment, a video voltage (so-called a grayscale voltage) is inputted to the sub pixel of red (R), the sub pixel of green (G) and the sub pixel of blue (B) in one pixel via different video lines (DL).

Accordingly, in this embodiment, an RGB switch circuit (RGB-SW) is provided to a scanning circuit (RDV) side. With this RGB switch circuit (RGB-SW), video voltages of red (R), green (G) and blue (B) which are outputted from the scanning circuit (RDV) during 1H period are respectively outputted to video lines (DL) for red (R), video lines (DL) for green (G) and the video lines (DL) for blue (B).

Further, to the sub pixel of red (R), the sub pixel of green (G) and the sub pixel of blue (B) in one pixel, a scanning voltage is inputted via the same scanning line (GL) during 1H period.

Accordingly, in this embodiment, although the number of video lines (DL) is tripled compared to the number of video lines in the above-mentioned embodiment 1, the number of scanning lines (GL) decreased to one third of the number of gate lines used in the embodiment 1 instead. That is, the number of scanning lines (GL) becomes 864.

In this embodiment, the scanning lines (GL) are divided into 36 pieces ($k_2$ pieces) of first groups. The number of scanning lines (GL) belonging to each first group is 24 ($k_1$).

Accordingly, the scanning circuit (RDV) includes, as terminals for the scanning lines (GL), 24 pieces ($k_1$ pieces) of terminals belonging to the first group (G0-1 to G0-24), and (2×36) pieces ($2k_2$ pieces) of terminals belonging to the second group (G1-1 to G1-36, G1-1(B) to G1-36(B)).

Since the manner of operation of this embodiment is equal to the manner of operation of the above-mentioned embodiment 1, their repeated detailed explanation is omitted.

In the above-mentioned respective embodiments, by setting a potential of the selective reversal scanning voltage of H level inputted to the gates of the second transistor (TR2) and the fourth transistor (TR4) lower than a potential of the selective scanning voltage of H level inputted to the gates of the first transistor (TR1) and the third transistor (TR3) (for example, the selective reversal scanning voltage being 50% or less of the selective scanning voltage), it is possible to further prolong the lifetime of the thin film transistor.

In the above-mentioned respective embodiments, the explanation has been made with respect to the case where the first transistor (TR1) to the fourth transistor (TR4) are formed of a poly-Si thin film transistor respectively. However, the first transistor (TR1) to the fourth transistor (TR4) may be formed of an a-Si thin film transistor or a microcrystalline Si thin film transistor. Further, each transistor may be formed of a stacked film which is constituted of an a-Si layer and a poly-Si layer or a stacked film which is constituted of an a-Si layer and a microcrystalline Si layer.

Further, in the above-mentioned respective embodiments, the explanation has been made with respect to the embodiments in which the present invention is applied to the liquid crystal display device. However, the present invention is not limited to the liquid crystal display device and is also applicable to a display device which uses organic light emitting diode elements or surface-conductive electron emission elements as a display panel thereof.

Although the invention made by the inventors of the present invention has been specifically explained in conjunction with the embodiments heretofore, it is needless to say that the present invention is not limited to the above-mentioned embodiments and various modifications are conceivable without departing from the gist of the present invention.

What is claimed is:

1. A display device comprising:

a plurality of pixels;

a plurality of scanning lines for inputting a scanning voltage to the plurality of pixels, the plurality of scanning lines being divided into "b" number of first scanning groups, each of the first scanning groups including anywhere from 1 to "a" number of the scanning lines;

a scanning line drive circuit which supplies the scanning voltage to the plurality of scanning lines;

"a" number of gate lines belonging to a first group, being connected to the scanning line drive circuit;

"b" number of gate lines belonging to a second group, being connected to the scanning line drive circuit;

"b" number of reverse gate lines belonging to the second group, being connected to the scanning line drive circuit;

a plurality of first transistors, each having a first electrode, a second electrode, and a control electrode, the first electrode being connected to one of the gate lines belonging to the first group, the second electrode being connected to one of the plurality of scanning lines, the control electrode being connected to one of the gate lines belonging to the second group; and a plurality of second transistors, each having a first electrode, a second electrode, and a control electrode, the first electrode being connected to one of the plurality of scanning lines, a predetermined reference potential being applied to the second electrode, the control electrode being connected to one of the reverse gate lines belonging to the second group, wherein:

the control electrodes of the first transistors connected to the scanning lines belonging to each first scanning group are all connected to same one of the gate lines belonging to the second group;

the control electrodes of the second transistors connected to the scanning lines belonging to each first scanning group are all connected to same one of the reverse gate lines belonging to the second group;

when a selective scanning voltage is applied to any one of the gate lines belonging to the second group and a non-selective reversal scanning voltage is applied to any one of the reverse gate lines belonging to the second group, wherein the first transistors being connected to the any one of the gate lines belonging to the second group and the second transistors being connected to the any one of the reverse gate lines belonging to the second group are both connected to the scanning lines belonging to same one of the first scanning groups, so that the first transistors being connected to the scanning lines belonging to the same one of the first scanning groups are turned on and the second transistors being connected to the scanning lines belonging to the same one of the first scanning groups are turned off; and when a non-selective scanning voltage is applied to the any one of the gate lines belonging to the second group and a selective reversal scanning voltage is intermittently applied to the any one of the reverse gate lines belonging to the second group, so that the first transistors being connected to the scanning lines belonging to the same one of the first scanning groups are turned off and the second transistors being connected to the scanning lines belonging to the same one of the first scanning groups are intermittently turned on.

2. A display device comprising:

a plurality of pixels;

a plurality of scanning lines for inputting a scanning voltage to the plurality of pixels, the plurality of scanning lines being divided into a plurality of first scanning groups, the plurality of the first scanning groups being divided into "c" number of second scanning groups, each of the first scanning groups including anywhere from 1 to "a" number of the scanning lines, each of the second scanning groups including "b" number of the first scanning groups;

a scanning line drive circuit which supplies the scanning voltage to the plurality of scanning lines;

"a" number of gate lines belonging to a first group, being connected to the scanning line drive circuit;

"b" number of gate lines belonging to a second group, being connected to the scanning line drive circuit;

"c" number of gate lines belonging to a third group, being connected to the scanning line drive circuit;

"b" number of reverse gate lines belonging to the second group, being connected to the scanning line drive circuit;

"c" number reverse gate lines belonging to the third group, being connected to the scanning line drive circuit; and a plurality of control circuits being respectively arranged on the plurality of scanning lines, each of the plurality of control circuits including:

a first transistor having a first electrode, a second electrode, and a control electrode, the first electrode being connected to one of the gate lines belonging to the first group, the control electrode being connected to one of the gate lines belonging to the second group;

a second transistor having a first electrode, a second electrode, and a control electrode, the first electrode being connected to the second electrode of the first transistor, the second electrode being connected to one of the plurality of scanning lines, the control electrode being connected to one of the gate lines line belonging to the third group;

a third transistor having a first electrode, a second electrode, and a control electrode, the first electrode being connected to one of the plurality of scanning lines, a predetermined reference potential being applied to the second electrode, the control electrode being connected to one of the reverse gate lines belonging to the second group; and a fourth transistor having a first electrode, a second electrode, and a control electrode, the first electrode being connected to the one of the plurality of scanning lines so that the third and fourth transistors are connected in parallel with respect to the one of the plurality of scanning lines, the predetermined reference potential being applied to the second electrode, the control electrode being connected to one of the reverse gate lines belonging to the third group, wherein:

the control electrodes of the first transistors connected to the scanning lines belonging to each first scanning group are all connected to same one of the gate lines belonging to the second group;

the control electrodes of the second transistors connected to the scanning lines belonging to each second scanning group are all connected to same one of the gate lines belonging to the third group;

the control electrodes of the third transistors connected to the scanning lines belonging to each first scanning group are all connected to same one of the reverse gate lines belonging to the second group;

the control electrodes of the fourth transistors connected to the scanning lines belonging to each second scanning group are all connected to same one of the reverse gate lines belonging to the third group;

when selective scanning voltages are respectively applied to any one of the gate lines belonging to the second group and any one of the gate lines belonging to the third group, and non-selective reversal scanning voltages are respectively applied to any one of the reverse gate lines belonging to the second group and any one of the reverse gate lines belonging to the third group, wherein the any one of the gate lines belonging to the second group, the any one of the reverse gate lines belonging to the second group, the any one of the gate lines belonging to the third group, and the any one of the gate lines belonging to the third group are connected to the control circuits being connected to the scanning lines belonging to same one of the first scanning groups, so that the first and second transistors being connected to the scanning lines belonging to the same one of the first scanning groups are turned on and the third and fourth transistors being connected to the scanning lines belonging to the same one of the first scanning groups are tuned off; and when a non-selective scanning voltage is applied to the any one of gate lines belonging to the second group or the any one of gate lines belonging to the third group, and a selective reversal scanning voltage is intermittently applied to the any one of the reverse gate lines belonging to the second group or the any one of the reverse lines belonging to the third group, so that the first or second transistors in the control circuits being connected to the scanning lines belonging to the same one of the first scanning groups is turned off and the third or fourth transistors in the control circuits being connected to the scanning lines belonging to the same one of the first scanning groups is intermittently turned on.

3. A display device comprising:

a plurality of pixels;

a plurality of scanning lines for inputting a scanning voltage to the plurality of pixels, assuming N as an integer of 2 or more, the plurality of scanning lines being divided into scanning groups ranging from first scanning groups to Nth scanning groups by hierarchical grouping, the hierarchical grouping being performed sequentially such that the plurality of scanning lines are divided into a plurality of first scanning groups, the plurality of first scanning groups are divided into a plurality of second scanning groups, a plurality of (N−2)th scanning groups are divided into a plurality of (N−1)th scanning groups, and the plurality of (N−1)th scanning groups are divided into a plurality of N-th scanning groups, each of the first scanning groups including anywhere from 1 to $k_1$ number of the scanning lines, each of the second scanning groups including $k_2$ number of the first scanning groups, each of the Nth scanning groups including $k_N$ number of the (N−1)th scanning groups sequentially;

a scanning line drive circuit which supplies the scanning voltage to the plurality of scanning lines;

a group of gate lines sequentially ranging from $k_1$ number of gate lines belonging to a first group and $k_2$ number of gate lines belonging to a second group to $k_N$ number of gate lines belonging to an Nth group, the group of gate lines being connected to the scanning line drive circuit;

a group of reverse gate lines sequentially raging from $k_2$ number of reverse gate lines belonging to the second group to $k_N$ number of reverse gate lines belonging to the Nth group, the group of reverse gate lines being connected to the scanning line drive circuit; and a plurality of control circuits being respectively arranged on the plurality of scanning lines, each of the plurality of control circuits including (2N−2) number of transistors ranging from a first transistor to a (2N−2)th transistor, each of the (2N−2) number of transistors including a first electrode, a second electrode, and a control electrode, (N−1) number of transistors ranging from the first transistor to the (N−1)th transistor being connected to each other in series, the second electrode of the (N−1)th transistor being connected to one of the plurality of scanning lines, (N−1) number of transistors ranging from the Nth transistor to the (2N−2)th transistor being connected to the one of the plurality of scanning lines via the first electrode thereof parallel to each other, a predetermined reference potential being respectively applied to the second electrodes of the (N−1) number of transistors ranging from the Nth transistor to the (2N−2)th transistor, the first electrode of the first transistor being connected to any one of the gate lines belonging to the first group, the control electrodes of the first to (N−1)th transistors being sequentially connected such that the control electrode of the first transistor is connected to any one of the gate lines belonging to the second group, and the control electrode of the (N−1)th transistor is connected to any one of the gate lines belonging to the Nth group, the control electrodes of the Nth to (2N−2)th transistors being sequentially connected such that the control electrode of the Nth transistor is connected to any one of reverse gate lines belonging to the second group, and the control electrode of the (2N−2)th transistor is connected to any one of the reverse gate lines belonging to the Nth group, wherein:

the control electrodes of the first transistors in the control circuits connected to the scanning lines belonging to each first scanning group are all connected to same one of the gate lines belonging to the second group;

the control electrodes of the (N−1)th transistors in the control circuits connected to the scanning lines belonging to each (N−1)th group are all connected to same one of the gate lines belonging to the Nth group sequentially;

the control electrodes of the Nth transistors in the control circuits connected to the scanning lines belonging to each first scanning group are all connected to same one of the reverse gate lines belonging to the second group, the control electrodes of the (2N−2)th transistors in the control circuits connected to the scanning lines belonging to each (N−1)th group are all connected to same one of the reverse gate lines belonging to the Nth group sequentially, when selective scanning voltages are respectively applied to any one of the gate lines belonging to the second group to any one of the gate lines belonging to the Nth group, and non-selective reversal scanning voltages are respectively applied to any one of the reverse gate lines belonging to the second group to any one of the reverse gate lines belonging to the Nth group, wherein both the any one of the gate lines belonging to the second group to the any one of the gate lines belonging to the Nth group and the any one of the reverse gate lines belonging to the second group to the any one of the reverse gate lines belonging to the Nth group are all connected to the control circuits being connected to the scanning lines belonging to same one of the first scanning groups, so that the first to (N−1)th transistors being connected to the scanning lines belonging to the same one of the first scanning groups are turned on and the Nth to (2N−2)th transistors being connected to the scanning lines belonging to the same one of the first scanning groups are turned off; and when a non-selective scanning voltage is applied to at least one gate line ranging from the any one of the gate lines belonging to the second group to the any one of the gate lines belonging to the Nth group, a selective reversal scanning voltage is intermittently applied to at least one gate line ranging from the any one of the reverse gate lines belonging to the second group to the any one of the gate lines belonging to the Nth group, so that at least one of the first to (N−1)th transistors in the control circuits being connected to the same one of the first scanning groups is turned off and at least one of the Nth to (2N−2)th transistors in the control circuits being connected to the same one of the first scanning groups is intermittently turned on.

4. The display device according to claim 3, wherein assuming a period during which the selective reversal scanning voltage is outputted to the respective reverse gate lines belonging to the second group to the Nth group from the scanning line drive circuit during 1 frame period as Ton, and a period during which the non-selective reversal scanning voltage is outputted to the respective reverse gate lines belonging to the second group to the Nth group from the scanning line drive circuit during 1 frame period as Toff, the relationship of $0.05 \leq Ton/(Ton+Toff) \leq 0.5$ is satisfied.

5. The display device according to claim 3, wherein the scanning line drive circuit outputs a first selective scanning voltage to the $k_1$ number of gate lines belonging to the first group for selecting the scanning lines belonging to each first scanning group for every 1 horizontal scanning period, the scanning line drive circuit outputs a second selective scanning voltage to the $k_2$ number of gate lines belonging to the second group for every $k_1$ horizontal scanning period sequentially, the scanning line drive circuit outputs a third selective scanning voltage to the $k_3$ number of gate lines belonging to the third group for every $(k_1 \times k_2)$ horizontal scanning period sequentially, and the scanning line drive circuit outputs an Nth selective scanning voltage to the $k_N$ number of gate lines belonging to the Nth group for every $(k_1 \times k_2 \times \ldots \times k_{(N-1)})$ horizontal scanning period sequentially.

6. The display device according to claim 3, further comprising:

a plurality of video lines for inputting a video voltage to the plurality of pixels; and a video line drive circuit which supplies the video voltage to the plurality of video lines, wherein said each pixel is constituted of a sub pixel of first color, a sub pixel of second color and a sub pixel of third color, the video voltage is inputted to the sub pixel of the first color, the sub pixel of the second color and the sub pixel of the third color in said each pixel from the same video line, $k_1$ number of gate lines belonging to the first group are constituted of scanning lines A of the first color, scanning lines B of the second color and scanning lines C of the third color, the scanning voltage is inputted to the sub pixel of the first color of said each pixel from the scanning line A of the first color, the scanning voltage is inputted to the sub pixel of the second color of said each pixel from the scanning line B of the second color, the scanning voltage is inputted to the sub pixel of the third color of said each pixel from the scanning line C of the third color, assuming a scanning period during which the video voltage is inputted to one row of the pixels as 1 horizontal scanning period, said 1 horizontal scanning period is divided into continuous first, second and third periods, and the video line drive circuit supplies the video voltage of the first color to each video line during the first period, the video voltage of the second color to said each video line during the second period, and the video voltage of the third color to said each video line during the third period, the scanning line drive circuit outputs a first selective scanning voltage for selecting the scanning lines A of the respective first scanning groups during the first period, the scanning lines B of the respective first scanning groups during the second period and the scanning lines C of the respective first scanning groups during the third period to $k_1$ number of gate lines belonging to the first group for every ⅓ horizontal scanning period, the scanning line drive circuit outputs a second selective scanning voltage to $k_2$ number of gate lines belonging to the second group for every $(⅓ \times k_1)$ horizontal scanning period sequentially, the scanning line drive circuit outputs a third selective scanning voltage to $k_3$ number of gate lines belonging to the third group for every $(⅓ \times k_1 \times k_2)$ horizontal scanning period sequentially, and the scanning line drive circuit outputs an Nth selective scanning voltage to the $k_N$ number of gate lines belonging to the Nth group for every $(⅓ \times k_1 \times k_2 \times \ldots \times k_{(N-1)})$ horizontal scanning period sequentially.

7. The display device according to claim 5, wherein the scanning line drive circuit outputs the reference potential to the $k_1$ number of gate lines belonging to the first group during the period in which the scanning line drive circuit outputs the second selective scanning voltage and after the first selective scanning voltage is outputted.

8. The display device according to claim 6, wherein the scanning line drive circuit outputs the reference potential to the $k_1$ number of gate lines belonging to the first group during the period in which the scanning line drive circuit outputs the second selective scanning voltage and after the first selective scanning voltage is outputted.

9. The display device according to claim 3, wherein the scanning line drive circuit is a circuit which is constituted of a thin film transistor where a semiconductor layer is formed of a polysilicon layer or a stacked layer of a polysilicon layer and an amorphous silicon layer, and the scanning line drive circuit is formed around a display part where the plurality of pixels are arranged.

10. The display device according to claim 3, wherein the scanning line drive circuit is a circuit which is constituted of a thin film transistor where a semiconductor layer is formed of a microcrystalline silicon layer or a stacked layer of a microcrystalline silicon layer and an amorphous silicon layer, and the scanning line drive circuit is formed around a display part where the plurality of pixels are arranged.

11. The display device according to claim 3, wherein the scanning line drive circuit is a circuit which is mounted in a semiconductor chip.

* * * * *